US006059281A

United States Patent [19]

Nakamura et al.

[11] Patent Number: 6,059,281

[45] Date of Patent: May 9, 2000

[54] SHEET FEEDING APPARATUS

[75] Inventors: Fumihiko Nakamura, Tokyo; Keizo Sasai, Yokohama, both of Japan

[73] Assignee: Canon Kabushiki Kaisha, Tokyo, Japan

[21] Appl. No.: 08/941,631

[22] Filed: Oct. 2, 1997

[30] Foreign Application Priority Data

| | | | |
|---|---|---|---|
| Oct. 3, 1996 | [JP] | Japan | 8-281842 |
| Dec. 11, 1996 | [JP] | Japan | 8-352244 |
| Dec. 26, 1996 | [JP] | Japan | 8-356936 |
| Dec. 26, 1996 | [JP] | Japan | 8-356976 |

[51] Int. Cl.[7] ..... B65H 3/52; B65H 1/08

[52] U.S. Cl. ..... 271/119; 271/121; 271/125; 271/127

[58] Field of Search ..... 271/114, 119, 271/120, 121, 125, 127

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,698,650 | 10/1987 | Watanabe et al. . | |
| 4,723,129 | 2/1988 | Endo et al. . | |
| 4,740,796 | 4/1988 | Endo et al. . | |
| 4,893,137 | 1/1990 | Ebinuma et al. . | |
| 4,969,048 | 11/1990 | Hoshino . | |
| 5,025,326 | 6/1991 | Shimmyo . | |
| 5,138,463 | 8/1992 | Morimoto et al. . | |
| 5,172,238 | 12/1992 | Kuboki . | |
| 5,206,666 | 4/1993 | Watanabe et al. . | |
| 5,249,062 | 9/1993 | Ejiri et al. . | |
| 5,329,373 | 7/1994 | Hayashi et al. . | |
| 5,359,435 | 10/1994 | Hayashi et al. . | |
| 5,430,468 | 7/1995 | Sasai et al. . | |
| 5,863,036 | 1/1999 | Tanaka et al. | 271/10.11 X |
| 5,882,004 | 3/1999 | Padget | 271/119 |

FOREIGN PATENT DOCUMENTS

| | | | |
|---|---|---|---|
| 0 271 090 | 6/1988 | European Pat. Off. . | |
| 0 297 566 | 1/1989 | European Pat. Off. . | |
| 0 389 285 | 9/1990 | European Pat. Off. . | |
| 54-56847 | 5/1979 | Japan . | |
| 358069642 | 4/1983 | Japan | 271/119 |
| 59-123670 | 7/1984 | Japan . | |
| 59-138461 | 8/1984 | Japan . | |
| 60-71260 | 4/1985 | Japan . | |
| 403162331 | 7/1991 | Japan | 271/119 |

*Primary Examiner*—Christopher P. Ellis
*Assistant Examiner*—Kenneth W. Bower
*Attorney, Agent, or Firm*—Fitzpatrick, Cella, Harper & Scinto

[57] ABSTRACT

A sheet feeding apparatus has a support for supporting sheets, a feed roller disposed at a downstream side of the supported sheets and adapted to feed out the sheet by rotating while contacting with the sheet, and a separation roller disposed at a downstream side of the sheet supporting device in the sheet feeding direction and in a confronting relation to the sheet feed device. A slip device generates slip between the feed roller and the sheet within a predetermined range when the feed roller starts to rotate, thereby preventing the feeding of the sheet and rotating the separation roller in the sheet feeding direction.

17 Claims, 18 Drawing Sheets

WAITING FOR PAPER FEEDING

STARTING ROTATION OF PAPER FEEDING SHAFT

STARTING OF PAPER FEEDING

PROCESSING OF PAPER FEEDING

PROCESSING OF PAPER FEEDING

FINISHING OF ONE ROTATION OF PAPER FEED ROLLER

WAITING FOR PAPER FEEDING

DRIVING PROCESS

WAITING FOR PAPER FEEDING

DRIVING PROCESS

WAITING FOR PAPER FEEDING

SHEET FEEDING APPARATUS

BACKGROUND OF THE INVENTION

1. Field of the Invention

The present invention relates to a sheet feeding apparatus used with an image forming apparatus such as a copying machine, a laser beam printer, an ink jet printer and a facsimile, and other sheet using apparatus.

And more particularly, it relates to an automatic sheet feeding apparatus in which sheets stacked on a sheet stacking plate as a sheet stack are separated and supplied one by one by a separation member and a separation/feed means comprised of a feed member urged against the sheet stack with predetermined pressure.

The sheet may be, for example, a transfer sheet, a recording sheet, a print sheet, an OHP sheet, an original, an envelope, a post card, a card or a film. The material of the sheet is not limited to paper but may be plastic, metal or cloth.

2. Related Background Art

An example of a conventional automatic sheet feeding apparatus is shown in FIGS. 20A and 20B. FIG. 20A is a schematic sectional view of a sheet feed portion of the apparatus and FIG. 20B is a schematic perspective view of the sheet feed portion of the apparatus.

A sheet stacking plate 51, 51*a* on which sheets S are stacked extends forwardly and downwardly. A front side portion 51 (referred to as "sheet feed pressure plate" hereinafter) of the sheet stacking plate can be pivoted around a hinge portion 51*b* and is always biased upwardly by a spring member (not shown). In a waiting condition for paper feeding, the sheet feed pressure plate 51 is lowered to a lower waiting position by a hold-down cam (not shown) in opposition to the spring member.

A semi-circular sheet feed roller 52 is disposed above a tip end of the sheet feed pressure plate 51*a* and is secured to a sheet feed shaft 53. The sheet feed shaft 53 is rotatably supported by bearings between side plates (not shown) of the apparatus and is intermittently rotated by one rotation by means of a one rotation clutch (not shown) in a sheet feeding direction whenever a sheet feed start signal is emitted. Thus, the sheet feed roller 52 is also intermittently rotated by one rotation.

A pair of idler rollers 54 disposed on both sides of the sheet feed roller 52 are rotatably mounted on shafts 55 held by the side plate of the apparatus.

Upper and lower sheet guide plates 56 serve to guide the sheet to a pair of sheet convey rollers 58 disposed at a downstream of the sheet feed roller 52 in a sheet conveying direction.

A separation pad 57 is provided on an upper surface of the lower guide plate 56 at an end thereof near the sheet feed pressure plate. The end of the lower guide plate near the sheet feed pressure plate is always biased upwardly by spring members (not shown) so that the separation pad 57 is urged against the pair of idler rollers 54 with predetermined pressure. During the rotation of the sheet feed roller 52, a cylindrical portion of the sheet feed roller is also urged against the separation pad 57 with predetermined pressure.

1) FIG. 20A shows a waiting condition for paper (sheet) feeding. In this condition, the sheet feed pressure plate 51 is held at a predetermined lower waiting position by hold-down cams (not shown) in opposition to the spring members, and the sheet feed roller 52 is stopped so that a D-cut portion (cutted flat portion) thereof is facing downwardly so as to separate the sheet feed roller 52 from the sheet stack S.

2) In this sheet feeding waiting condition, a sheet feed start signal is inputted to a control circuit, one rotation of the sheet feed shaft 53 and accordingly the sheet feed roller 52 is started. Further, the sheet feed pressure plate 51 is released from the cams, with the result that the sheet feed pressure plate 51 is lifted by the spring members. Rotation of the pair of sheet convey rollers 58 is also started. Incidentally, the pair of sheet convey rollers 58 may be always rotated.

In an initial phase of the rotation of the sheet feed roller 52, an edge 52*a* between the cutted flat portion and the cylindrical portion of the sheet feed roller 52 is urged, with predetermined pressure, against a front upper end portion of the sheet stack S lifted by the sheet feed pressure plate, with the result that a feeding force due to contact friction of the sheet feed roller 52 acts on an uppermost sheet S1 in the sheet stack S. FIG. 21A shows this condition.

3) A tip end of the fed-out uppermost sheet S1 enters into and passes through a nip (separation nip) between the idler rollers 54 and the separation pad 57 and then is pinched between the cylindrical portion of the rotating sheet feed roller 52 and the separation pad 57 to be supplied by the contact friction of the sheet feed roller 52. This condition is shown in FIG. 21B. The idler rollers 54 are rotatingly driven by the movement of the sheet S1.

Second and other sheets trying to move together with the uppermost sheet S1 are prevented by the separation pad 57 from entering into the nip between the separation pad 57 and the idler rollers 54 and the nip between the separation pad 57 and the cylindrical portion of the sheet feed roller 52, with the result that only the uppermost sheet S1 is supplied by the contact friction of the sheet feed roller 52.

4) FIG. 21C shows a condition the sheet S1 is further fed by the rotation of the sheet feed roller 52. Up to this time, the tip end of the sheet reaches a nip between the sheet convey rollers 58 to stably relay the sheet to the pair of sheet convey rollers 58, and the sheet feed pressure plate 51 is again held at the predetermined lower waiting position by the hold-down cams (not shown) in opposition to the spring members to separate the sheet feed roller 52 from the sheet stack S.

5) After the sheet feed roller 52 is rotated by one rotation, when it is returned to the lower waiting position where the cutted flat portion of the roller is facing downwardly, the sheet feed roller is stopped. This condition is shown in FIG. 22A. Even when the sheet feed roller 52 is stopped, the uppermost sheet S1 continues to be conveyed by the pair of sheet convey rollers 58. In the condition that the semi-circular sheet feed roller 52 is separated from the separation pad 57, if the second and other sheets are moved together with the uppermost sheet S1, since the idler rollers 54 are frictionally contacted with the separation pad, only the uppermost sheet S1 is conveyed, and the second and other sheets are prevented from being double-fed.

6) After a trail end of the uppermost sheet S1 being conveyed leaves the nip between the separation pad 57 and the idler rollers 54 and the sheet feed roller 52, when a next sheet feed start signal is inputted to the control circuit, the same operation cycle (from 1 to 5) is repeated to effect the separation and feeding of the next sheet.

By the way, in the above-mentioned conventional sheet feeding apparatus, in the initial period of the sheet feeding, it is apprehended that the tip end of the sheet S1 does not enter into but is stopped by the nip (separation nip) between the idler rollers 54 and the separation pad 57 to cause the buckling at as tip end portion Sa of the sheet, as shown in FIG. 22B, thereby shrinking or folding or (in the worst case) damaging the tip end of the sheet.

Regarding this, in the initial period of the sheet feeding, as shown in FIG. 21A, the edge 52*a* between the cutted flat portion and the cylindrical portion of the sheet feed roller 52 contacts with the sheet stack S not at the tip end thereof but at a position spaced apart from the tip end by a distance Sa, and a tip end portion of the sheet S1 (fed out by the sheet feed roller 52) having a length corresponding to this distance Sa is conveyed to the separation nip forwardly of the edge 52*a* between the cutted flat portion and the cylindrical portion of the sheet feed roller 52 without being backed-up by the sheet feed roller 52 to try to enter into the separation nip between the idler rollers 54 and the separation pad 57 by utilizing resiliency of the sheet itself.

In this case, since the idler rollers can be freely rotated in opposition to the contact friction between these rollers and the separation pad 57 and do not have self-rotational driving force in the sheet conveying direction, in dependence upon the resiliency of the sheet, the resiliency of the sheet does not overcome the resistance force of the separation nip tending to prevent the tip end of the sheet from entering into the separation nip, with the result that the tip end portion Sa of the sheet S1 cannot enter into the separation nip but is stopped by the separation nip. In this condition, since the sheet S1 is further conveyed by the sheet feed roller 52, the buckling of the tip end portion Sa is generated at the separation nip.

SUMMARY OF THE INVENTION

An object of the present invention is to provide a sheet feeding apparatus which can eliminate the above-mentioned conventional drawbacks and in which buckling of a tip end portion of a sheet can be prevented from occurring at a separation portion to avoid folding and damage of the tip end portion of the sheet, thereby ensuring reliability and preventing poor conveyance.

Another object of the present invention is to provide a sheet feeding apparatus which can easily be handled by a user and which is inexpensive and has good quality.

To achieve the above object, according to the present invention, there is provided a sheet feeding apparatus comprising a sheet supporting means for supporting sheets, a sheet feed means disposed at a downstream side of the sheet supported by the sheet supporting means in a sheet feeding direction and adapted to feed out the sheet by rotating while contacting with the sheet, a separation means disposed at a downstream side of the sheet supporting means in the sheet feeding direction in a confronting relation to the sheet feed means and adapted to cooperate with the sheet feed means to separate the sheets fed out from the sheet supporting means by the sheet feed means one by one, and a slip means provided in the sheet feed means and adapted to generate slip between the sheet feed means and the sheet within a predetermined range when the sheet is started to be fed by the sheet feed means, thereby preventing the feeding of the sheet.

DETAILED DESCRIPTION OF THE PREFERRED EMBODIMENTS

Figure 1:
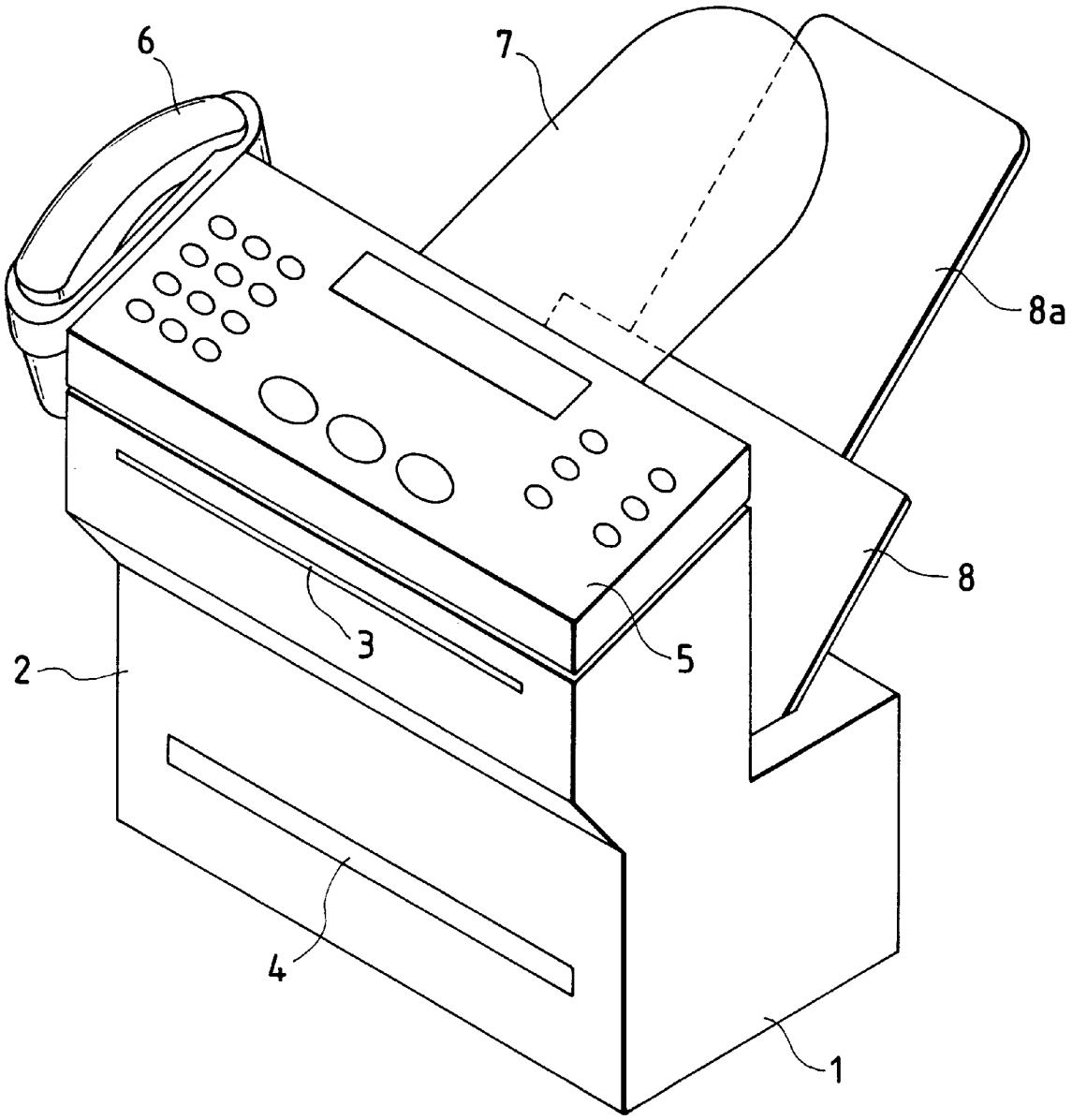
FIG. 1 is a schematic perspective view of a facsimile apparatus as an example of an image forming apparatus having a sheet feeding apparatus according to the present invention.
Figure 2:
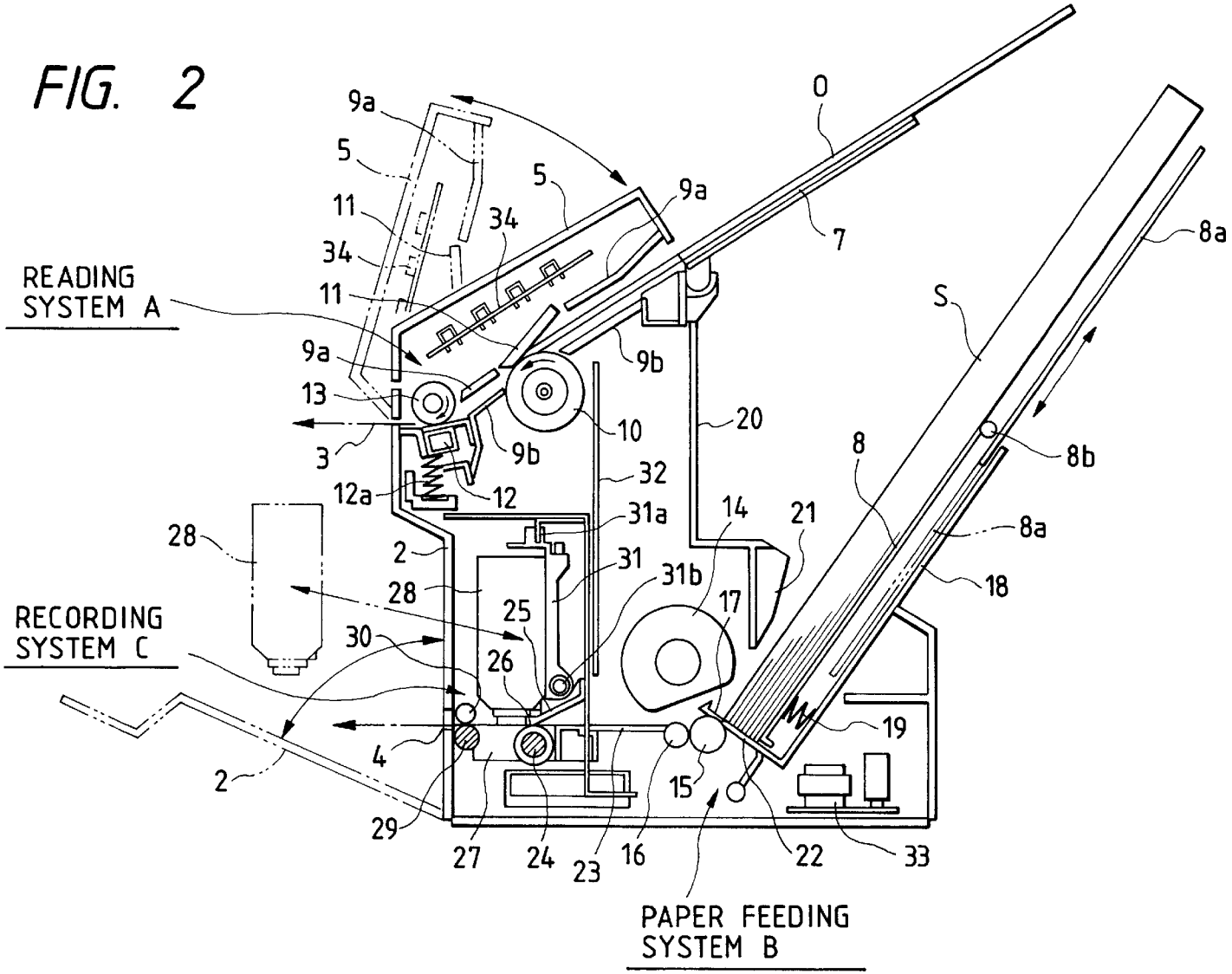
FIG. 2 is a schematic sectional view showing an internal structure of the apparatus of FIG. 1.
Figure 3:
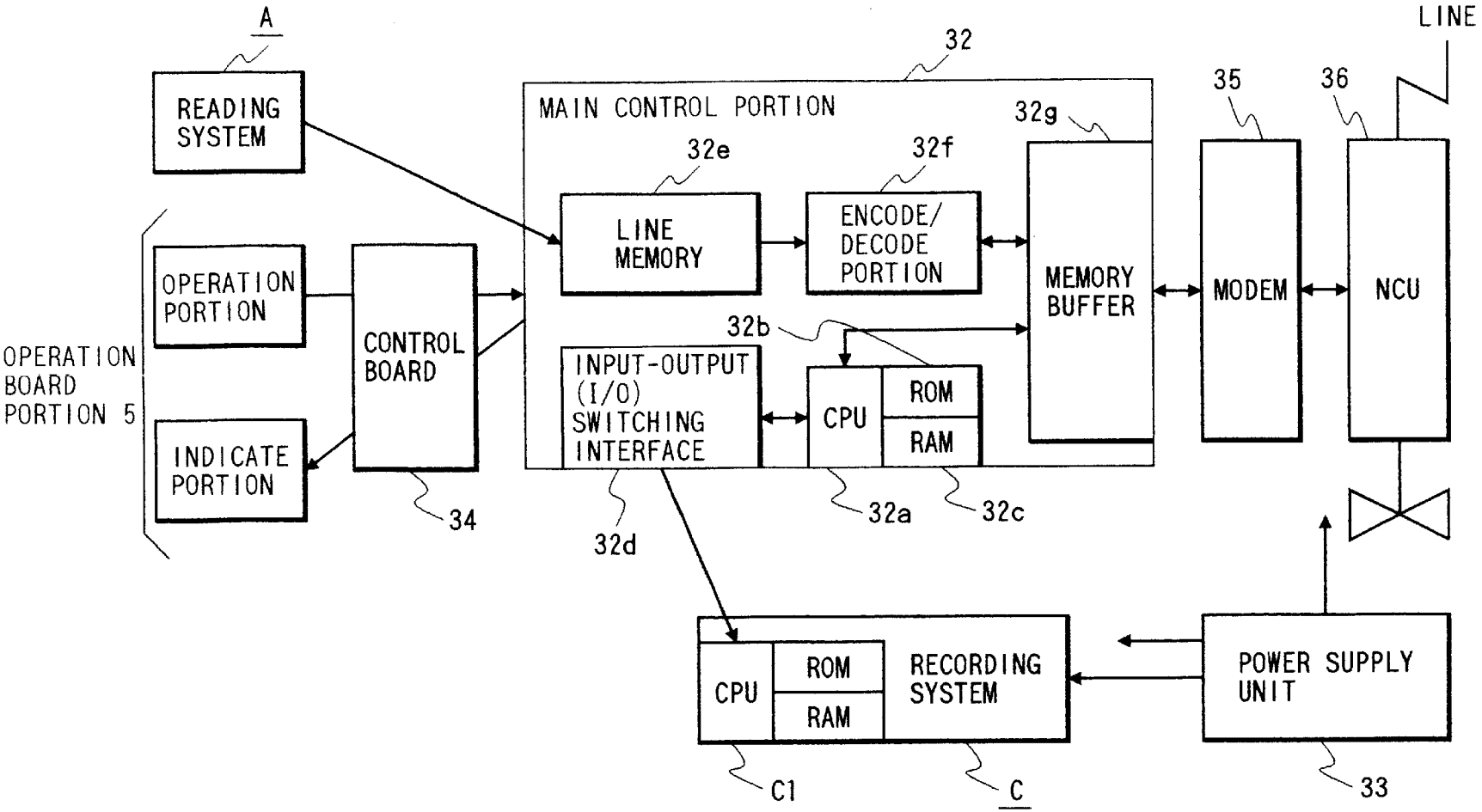
FIG. 3 is a block diagram of a control system of the facsimile apparatus.

FIG. 1 is a schematic perspective view of a facsimile apparatus as an example of an image forming apparatus having a sheet feeding apparatus according to the present invention, FIG. 2 is a schematic sectional view showing an internal structure of the apparatus of FIG. 1, and FIG. 3 is a block diagram of a control system of the facsimile apparatus.

(1) Entire Construction of Facsimile Apparatus

In FIG. 1, the reference numeral 1 denotes an outer frame (body cover) of the facsimile apparatus; 2 denotes a front cover portion of the body cover; 3 denotes a lateral elongate slit-shaped original discharge opening formed in an upper part of the cover portion 2; and 4 denotes a lateral elongate slit-shaped recording sheet discharge opening formed in a lower part of the cover portion 2. When the front cover portion 2 is opened forwardly around a lower hinge (not shown) as shown by the two dot and chain line in FIG. 2, a front side of the facsimile apparatus can be greatly exposed.

An operator can command a signal sending operation, a copying operation and scanning operation via various keys, push buttons and displays arranged on an operation panel (operation portion) 5 disposed on the top of the facsimile apparatus. The operation panel 5 can be opened forwardly around a lower hinge (not shown) as shown by the two dot and chain line in FIG. 2 to expose an original convey path of a reading system A which will be described later.

In FIG. 1, the reference numeral 6 denotes a telephone hand set disposed at one side of the facsimile apparatus; 7 denotes an original tray disposed on a rear side of the facsimile apparatus at an upper part thereof; 8 denotes a recording sheet tray disposed on the rear side of the facsimile apparatus at a lower part thereof; and 8*a* denotes a retractable auxiliary recording sheet tray.

In FIG. 2, the reading system A serves to photo-electrically read image information on an original, a paper (sheet) feeding system (sheet feeding apparatus) B serves to separate and supply recording sheets one by one, and a recording system C serves to the image information on the recording sheet.

a) Reading System A

In the facsimile apparatus, the reading system A is disposed within the apparatus at an upper part thereof and below the operation panel 5 and includes a forwardly and downwardly extending original tray 7, upper and lower original convey guides 9*a*, 9*b*, a separation roller 10, a friction piece 11, a photo-electrical reading unit (contact sensor in the illustrated embodiment) 12, and a feed roller 13.

A single original 0 or an original stack is rested on the original tray 7 so that a tip end of the original abuts against a wedge-shaped nip between the separation roller 10 and the friction piece 11 urged downwardly against the separation roller 10.

In response to an original reading start signal, the separation roller 10 is rotated at a predetermined peripheral speed in an original feeding direction by means of a drive system (not shown), and the separation roller cooperates with the friction piece 11 to separate only a lowermost original from the original stack 0. The separated original is passed through the nip between the separation roller 10 and the friction piece 11 and is guided by the guides 9*a*, 9*b* to reach a nip (reading portion) between the reading unit 12 and the feed roller 13. The friction piece 11 serves to handle the plural originals one by one.

The photo-electrical reading unit 12 is biased upwardly by a biasing spring 12*a* to urge a photo-electrical reading surface against a lower part of the feed roller 13. The feed roller has a white surface acting as reading background.

In response to the original reading start signal, the feed roller 13 is rotated at a predetermined peripheral speed in the original feeding direction by means of a drive system (not shown). The original separated by the separation roller 10 and the friction piece 11 enters into the nip between the reading unit 12 and the feed roller 13. The original passes through the nip while an imaged surface (lower surface) of the original is being slid on the photo-electrical reading surface of the photo-electrical reading unit 12. Meanwhile, the image information of the original is successively read by the photo-electrical reading unit 12. The photo-electrical reading unit 12 illuminates light onto the original, and reflection light reflected from the original is converted to an electrical signal (time-lapse electrical digital signal).

The image signal photo-electrically read by the photo-electrical reading unit 12 is transmitted to another apparatus (opposite party facsimile) or to the recording system C of this facsimile apparatus for the copying operation.

The read original is discharged onto an original discharge tray (not shown) through the original discharge opening 3 formed in the front cover portion 2 at the upper part thereof.

The originals 0 stacked on the original tray 7 are successively separated and supplied one by one from a lowermost one, and the supplied original is photo-electrically read and then is discharged onto the original discharge tray through the original discharge opening 3.

If the original is jammed in an original convey path of the reading system A, by opening the operation panel 5 as shown by the two dot and chain line in FIG. 2 to expose the original convey path of the reading system A, the jammed original can easily be removed.

b) Paper Feeding System B

The paper feeding system B comprises a sheet feeding apparatus according to the present invention, which will now be briefly described and will be fully described later in item 2).

In the facsimile apparatus, the paper feeding system B is disposed within the apparatus at a rear part thereof and includes a forwardly and downwardly extending sheet (recording sheet) tray 8 as a recording sheet stacking tray, a sheet feed roller 14 (semi-circular roller in the illustrated embodiment) 14 as a recording sheet feed member, a friction separation roller 15 as a recording sheet separation member, auxiliary rollers 16 as recording sheet convey auxiliary members, and recording sheet return levers 17 as recording sheet double-feed preventing members.

The recording sheet tray 8 is constituted by a sheet stacking plate (pressure plate) supported for rocking movement in an up-and-down direction. The recording sheet tray 8 is pivotally connected at its rear end to an upper surface of a fixed base plate 18 (disposed at a rear side of the apparatus and extending forwardly and downwardly) via a hinge portion 8*b* and is always biased upwardly (around the hinge portion 8*b*) by a biasing spring 19 disposed between the recording sheet tray 8 and the fixed base plate 18.

The recording sheet auxiliary tray 8*a* is housed between the recording sheet tray 8 and the fixed base plate 18. When the recording sheet auxiliary tray 8*a* is extended outwardly, it can act as an extension of the recording sheet tray 8.

In the illustrated embodiment, a normal paper sheet having B4 or A4 size is used as a recording sheet S. A predetermined maximum limit number (regulated by a recording sheet stack height regulating plate 21 provided on a rear cover 20) of recording sheets can be stacked on the recording sheet tray 8 (and the extended recording sheet auxiliary tray 8*a*). Further, lateral edges of the recording sheets S stacked on the trays 8, 8*a* are regulated by recording sheet side guides (not shown).

A right angle bent portion 22 formed on a front end of the fixed base plate 18 acts as an abutment plate against which a tip end of the recording sheet stack abuts. As a result, the recording sheet stack S rested on the forwardly and downwardly extending trays 8, 8*a* always tends to slid downwardly by its own weight to abut the tip end thereof against the abutment plate 22.

In response to a paper feed start signal, the paper feeding system B is operated to separate the uppermost recording sheet from the recording sheet stack S, and the separated recording sheet is introduced into the recording system C through a recording sheet convey guide 23.

c) Recording System C

In the illustrated embodiment, the recording system C is disposed in front of the paper feeding system B and below the reading system A.

The recording system C serves to record an image on the recording sheet supplied from the paper feeding system B in response to an image signal transmitted from another apparatus (opposite party facsimile) or in response to an image signal photo-electrically read by the reading system A in a copy mode. Various kinds of image recording means can be used to form the image on the recording sheet. In the illustrated embodiment, an ink jet recording means is used.

The recording system C includes an LF roller (recording sheet convey roller) 24, a recording sheet hold-down member 25, a pinch roller 26, a platen plate 27, a recording cartridge (recording head) 28, a sheet discharge roller 29 and a spur wheel roller 30.

The LF roller 24 and the sheet discharge roller 29 are controlled to be rotated at a predetermined speed in a recording sheet feeding direction. The pinch roller 26 and the spur wheel roller 30 are urged against the LF roller 24 and the sheet discharge roller 29 from the above, respectively and are rotatingly driven. The recording sheet hold-down member 25 is biased toward the LF roller 24 to oppose the pinch roller 26 to the LF roller 24 and also acts as an upper guide for the recording sheet.

The recording cartridge 28 is mounted on a slider 31 (with a recording surface of the cartridge facing downwardly) shifted along guide rail members 31*a*, 31*b* extending in a left-and-right direction (direction perpendicular to the plane of FIG. 2) so that the cartridge can be shifted together with the slide 31 in the left-and-right direction. The platen plate 27 acts as a recording sheet back-up member opposed to the downwardly directed recording surface of the recording cartridge 28.

The recording sheet conveyed from the paper feeding system B is pinched by a nip between the LF roller 24 and the pinch roller 26 and is passed between the recording cartridge 28 and the platen plate 27; meanwhile, the image is formed on the recording sheet by the recording cartridge 28. In the illustrated embodiment, the recording cartridge 28 performs serial recording while shifting in a width-wise direction of the recording sheet (direction perpendicular to the recording sheet conveying direction).

After the recording, the recording sheet is pinched between the sheet discharge roller 29 and the spur wheel roller 30 without smudging the recorded surface and is discharged forwardly through the recording sheet discharge opening 4 formed in the front cover portion 2.

By opening the front cover portion 2 as shown by the two dot and chain line in FIG. 2, the recording cartridge 28 is exposed to outside. In this condition, the recording cartridge 28 can be dismounted from the slider 31 and a new recording cartridge can be mounted on the slider.

In FIG. 2, the reference numeral 32 denotes a main control substrate (main control portion) for controlling the facsimile apparatus; 33 denotes a power supply unit for supplying electric power to the entire facsimile apparatus; and 34 denotes an operation panel control substrate disposed inside of the operation panel 5.

d) Control System

FIG. 3 is a block diagram of the control system of the apparatus. The reference numeral 35 denotes a modem substrate unit; and 36 denotes a communication substrate unit to which the telephone is connected.

The main control portion 32 includes a CPU 32*a* for controlling the entire facsimile apparatus, a ROM 32*b* for storing various programs and various data, a RAM 32*c* used as a work area for the CPU 32*a* and temporarily storing various data (for example, number of copies), an I/O switching interface 32*d*, a line memory 32*e*, code (encode)/decode portion 32*f*, and a memory buffer (buffer memory) 32*g*.

The line memory 32*e* is a memory for storing images of respective lines of the image data. In case of the original sending mode or the copy mode, the image data corresponding to one-line from the original reading system A is stored, and, in case of the image data receiving mode, the decoded data corresponding to one-line is stored. The image data stored in the line memory 32*e* is sent to the CPU 32*a*, where the recording system control code is added to the image data and then is outputted to a CPU C1 of the recording system C through the I/O switch interface 32*d*. The image is recorded by decoding the recording system control code by means of the CPU C1.

The code/decode portion 32*f* serves to code the image information to be sent by MH coding or to decode the received coded image data to convert it into image data. The memory buffer 32*g* serves to store the sent or received coded image data.

(2) Details of Paper Feeding System (Sheet Feeding Apparatus) B a) Structure

Figure 4A:
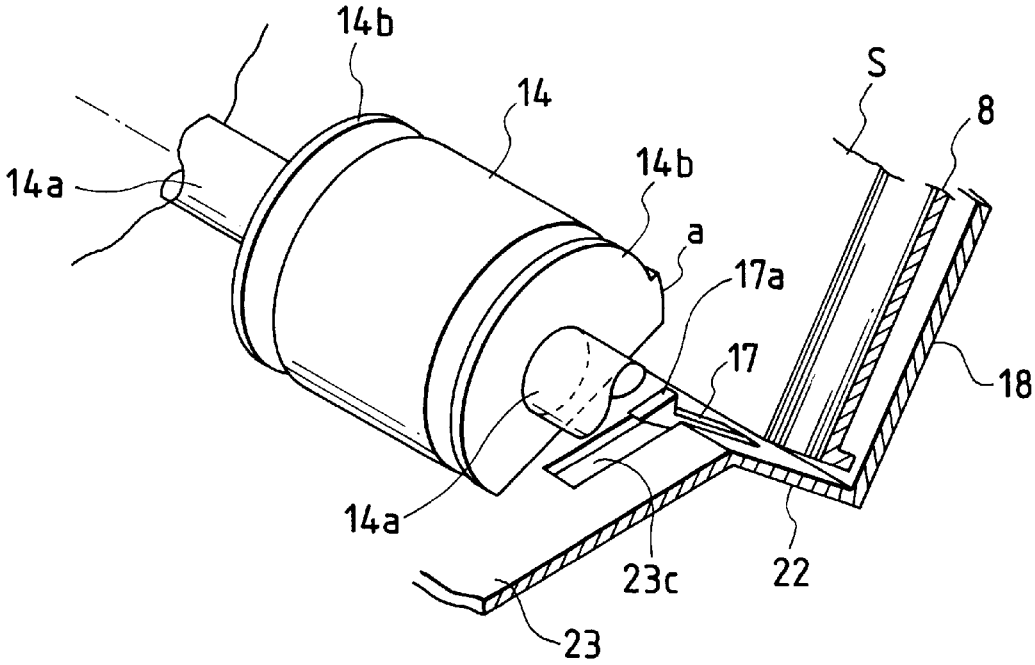
FIG. 4A is a schematic perspective view of a sheet feed roller portion of a paper (sheet) feeding system.
Figure 4B:
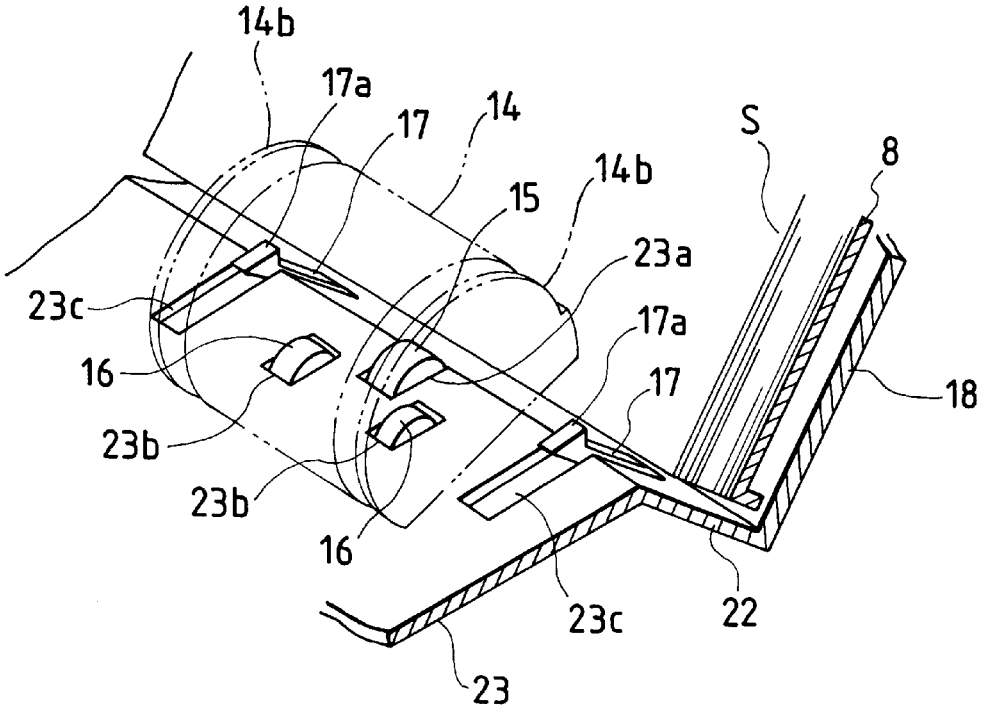
FIG. 4B is a schematic perspective view of a friction separation roller/auxiliary roller portion disposed below the sheet feed roller.
Figure 5:
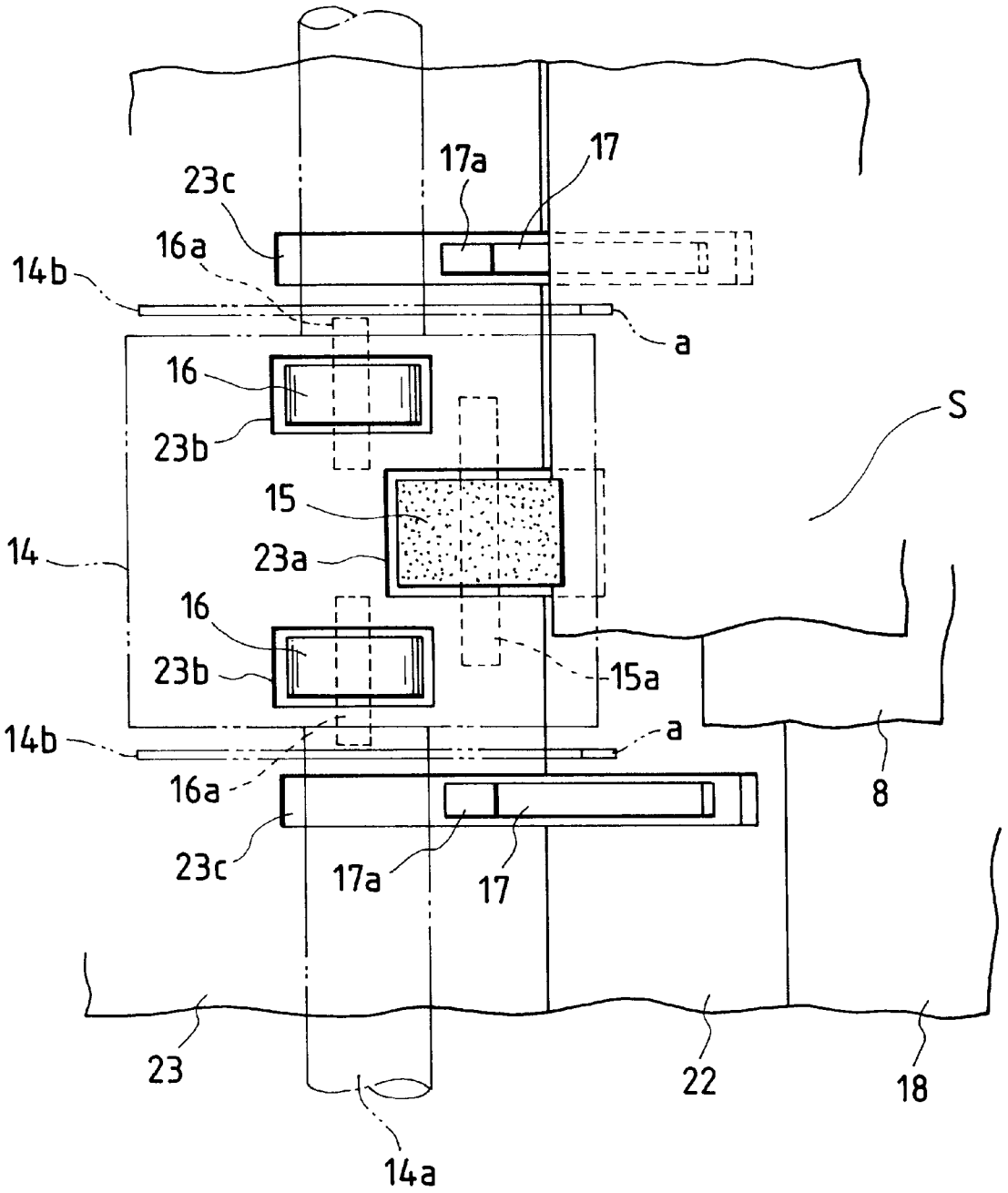
FIG. 5 is a schematic plan view of the friction separation roller/auxiliary roller portion.
Figure 6A:
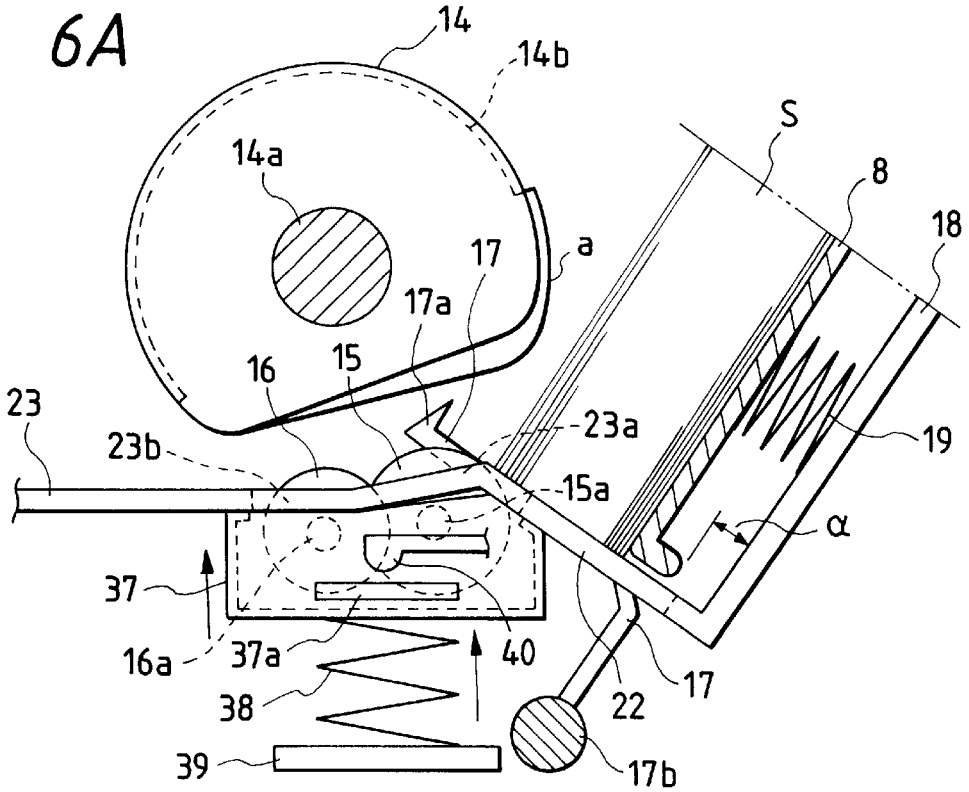
FIGS. 6A and 6B are explanatory views showing a push-down mechanism for the friction separation roller/auxiliary roller unit.
Figure 6B:
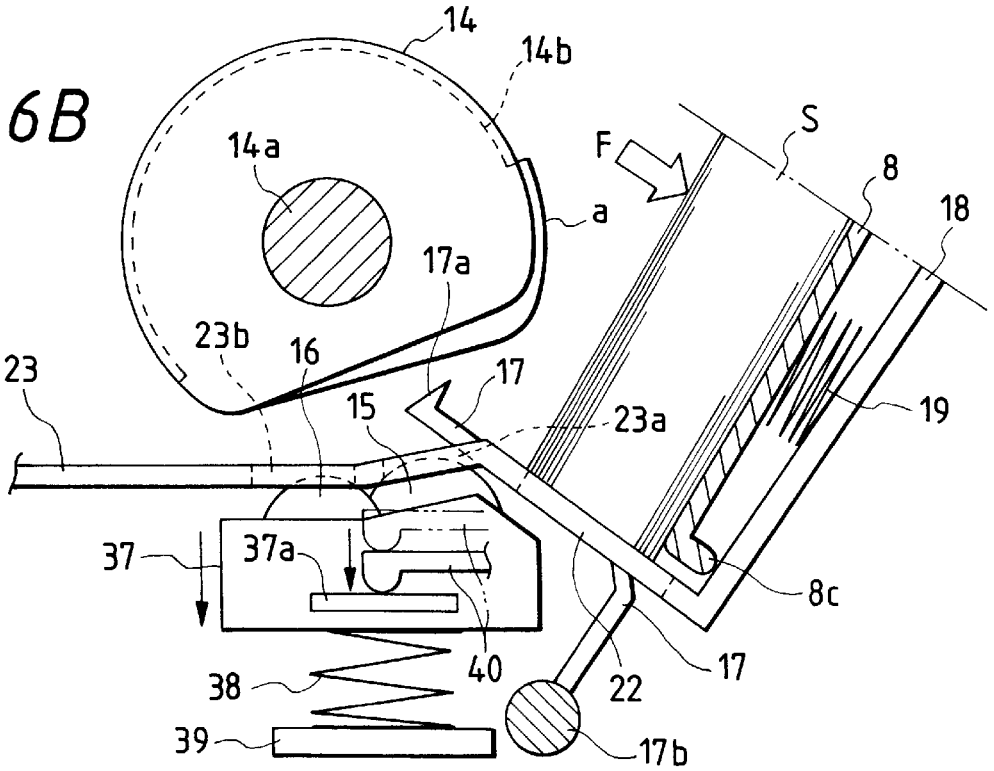
Figure 7A:
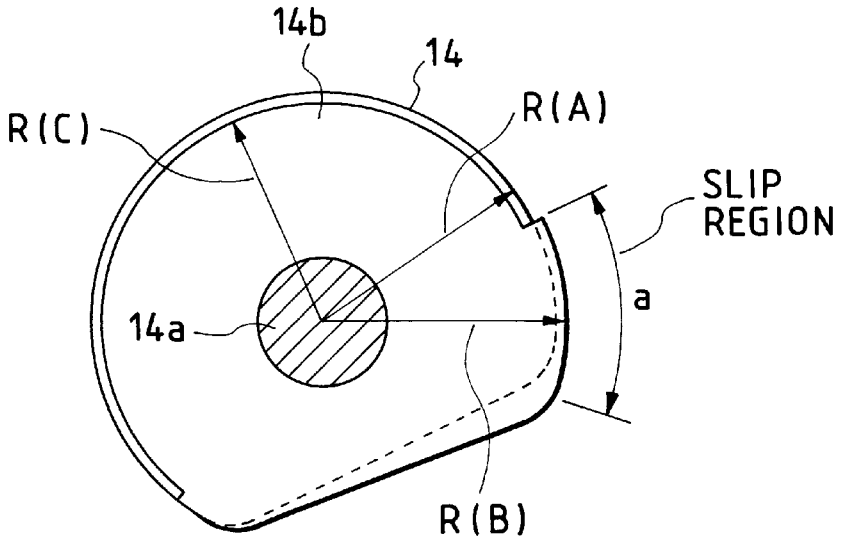
FIG. 7A is a side view of a sheet feed roller/sheet feed roller ribs.
Figure 7B:
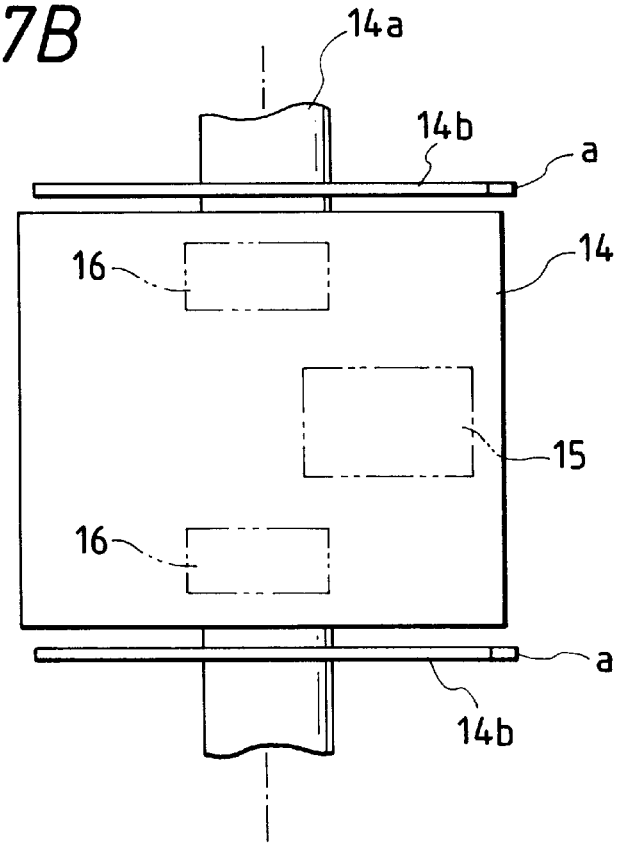
FIG. 7B is a plan view of the sheet feed roller/sheet feed roller ribs.

FIG. 4A is a schematic perspective view of a sheet feed roller portion of the paper (sheet) feeding system, FIG. 4B is a schematic perspective view of a friction separation roller/auxiliary roller portion disposed below the sheet feed roller, FIG. 5 is a schematic plan view of the friction separation roller/auxiliary roller portion, FIGS. 6A and 6B are explanatory views showing a push-down mechanism for the friction separation roller/auxiliary roller unit, FIG. 7A is a side view of a sheet feed roller/sheet feed roller ribs, and FIG. 7B is a plan view of the sheet feed roller/sheet feed roller ribs.

As mentioned above, the fixed support plate 18 on which the recording sheet tray (rockable sheet stacking plate) 8 is provided has the upwardly right-bent portion to form the abutment plate 22 against which the tip end of the recording sheet stack abuts, and, in the illustrated embodiment, a tip end of the abutment plate 22 is extended to form a recording sheet convey guide 23 to the recording system C.

In the illustrated embodiment, the sheet feed roller (recording sheet feed member) 14 comprises a semi-circular roller disposed above a junction between the abutment plate 22 and the recording sheet convey guide 23. The sheet feed roller 14 is secured to a sheet feed shaft 14*a*.

A pair of sheet feed roller ribs 14*b* are secured to the sheet feed shaft 14*a* on both sides of the sheet feed roller 14. As will be described later, the sheet feed roller ribs 14*b* are members for forming a slip area (not conveying the sheet) on the sheet feed roller 14.

Although not shown, the sheet feed roller 14*a* is rotatably supported between the side plates of the apparatus and is intermittently rotated by one rotation in the sheet feeding direction by a one rotation clutch mechanism whenever the sheet is supplied. The sheet feed roller 14 and the sheet feed roller ribs 14*b* are rotated by one rotation together with the sheet feed shaft 14*a*.

A through opening 23*a* for opposing a friction separation roller (recording sheet separation member) 15 to the sheet feed roller 14 is formed in the recording sheet convey guide 23 at a position immediately below the sheet feed roller 14, and a pair of through openings 23*b* for opposing auxiliary rollers (recording sheet convey auxiliary members) 16 to the sheet feed roller 14 are formed in the recording sheet convey guide 23 at positions on both sides of the through opening 23*a* and at a downstream side of the through opening 23*a* in the recording sheet conveying direction. The friction separation roller 15 and the auxiliary rollers 16 are opposed to the sheet feed roller 14 through the through openings 23*a*, 23*b* from the below.

In the apparatus according to the illustrated embodiment, as shown in FIGS. 6A and 6B, the friction separation roller 15 and the auxiliary rollers 16 are incorporated into a common frame via bearings with a predetermined arrangement to form one unit (friction separation roller/auxiliary roller unit) 37. The unit 37 is guided for vertical movement by guide members (not shown) below the recording sheet convey guide 23 and is always biased upwardly by a biasing spring 38 so that, in a free condition, the unit 37 is urged against a lower surface of the recording sheet convey guide 23 as shown in FIG. 6A. The reference numeral 39 denotes a fixed spring seat; and 15*a*, 16*a* denote rotary shafts for the friction separation roller 15 and the auxiliary rollers 16.

In this condition, the friction separation roller 15 and the auxiliary rollers 16 are protruded from the upper surface of the recording sheet convey guide 23 through the respective through openings 23*a*, 23*b* by predetermined amounts.

In the illustrated embodiment, the friction separation roller 15 is constituted by a so-called retard roller rotated in a recording sheet returning direction via a torque limiter (not shown). The roller 15 may not be rotatingly driven. The auxiliary rollers 16 are freely rotated.

When the semi-circular sheet feed roller 14 is rotated, as mentioned above, the cylindrical portion of the sheet feed roller 14 is contacted with the friction separation roller 15 and the auxiliary rollers 16 protruded from the upper surface of the recording sheet convey guide 23 through the respective through openings 23*a*, 23*b* by the predetermined amounts. In this case, it is so designed that the friction separation roller 15 and the auxiliary rollers 16 are slightly pushed downwardly by the cylindrical portion of the sheet feed roller 14 in opposition to the biasing spring 38 so that the cylindrical portion of the sheet feed roller 14 is contacted with the friction separation roller 15 and the auxiliary rollers 16 with predetermined pressures due to the reaction force of the spring 38.

A member 40 for pushing the unit 37 downwardly serves to shift the unit 37 downwardly to permit the removal of the recording sheet jammed between the sheet feed roller 14 and the friction separation roller 15/auxiliary rollers 16, thereby facilitating the jam treatment, if the recording sheet is jammed between the sheet feed roller 14 and the friction separation roller 15/auxiliary rollers 16 during the recording sheet feeding operation, which will be described later.

The member 40 is positioned above a receiving plate 37*a* formed integrally with the unit 37 so that it does not normally interfere with the receiving plate 37*a*. When the member 40 is lowered, the member 40 urges the receiving plate 37*a* downwardly to lower the unit 37 in opposition to the spring 38, as shown in FIG. 6B.

In the illustrated embodiment, the pushing member 40 is operated in synchronous with the rocking movement of the recording sheet tray (rockable sheet stacking plate) 8 within an over-stroke range α.

That is to say, as mentioned above, the recording sheet tray 8 is always biased upwardly around the hinge portion 8*b* by the biasing springs 19 disposed between the recording sheet tray 8 and the fixed support plate 18. In the sheet feeding operation, the recording sheet tray 8 is pushed downwardly to a predetermined waiting position in opposition to the biasing springs 19 by means of tray cams (described later) moved in synchronous with the rotation of the sheet feed shaft 14*a*. This recording sheet tray waiting condition is shown in FIG. 6A.

In the waiting condition of the recording sheet tray 8, there is a play that the recording sheet tray 8 can be lowered by pushing the recording sheet tray or the upper surface of the recording sheet stack S rested on the recording sheet tray 8 downwardly by a finger force F in opposition to the biasing springs 19 until a downwardly direction protruded front edge 8*c* of the tray 8 abuts against the inner surface of the fixed support plate 18, as shown in FIG. 6B. When the finger force F is released, the recording sheet tray 8 is pushed upwardly by the biasing springs 19 to return to the waiting condition shown in FIG. 6A. The up/down rocking play a of the recording sheet tray 8 from the condition shown in FIG. 6A to the condition shown in FIG. 6B or from the condition shown in FIG. 6B to the condition shown in FIG. 6A is the above-mentioned over-stroke range of the recording sheet tray 8.

In the apparatus according to the illustrated embodiment, by lowering the member 40 in synchronous with the lowering movement of the recording sheet tray 8 within the over-storke range α, the unit 37 is lowered in opposition to the spring 38 (from the condition shown in FIG. 6A to the condition shown in FIG. 6B), and, by lifting the member 40 in synchronous with the lifting movement of the recording sheet tray 8 to release the force acting on the unit 37, the unit 37 is returned to the normal condition (from the condition shown in FIG. 6B to the condition shown in FIG. 6A).

The pushing member 40 may be formed integrally with the recording sheet tray 8 or may be connected to the recording sheet tray 8 via a lever or a link to be operated in synchronous with the up/down rocking movement of the tray 8 within the over-stroke range α.

The pair of recording sheet return levers 17 acting as the recording sheet double-feed preventing members are disposed on both sides of the sheet feed roller 14 and are identical members secured, with the same phase angles, to a lever shaft 17*b* rotatably supported between the side plates of the apparatus below the recording sheet convey guide 23 and in front of the abutment plate 22. The return levers 17 can be rotated in a normal direction or a reverse direction together with the lever shaft 17*b*. Each return lever 17 is provided at its free end with a pawl (hook) portion 17*a*.

Though holes 23*c* for receiving the recording sheet return levers 17 are formed in portions of the abutment plate 22 and the recording sheet convey guide 23 corresponding to the positions of the return levers 17.

Figure 8:
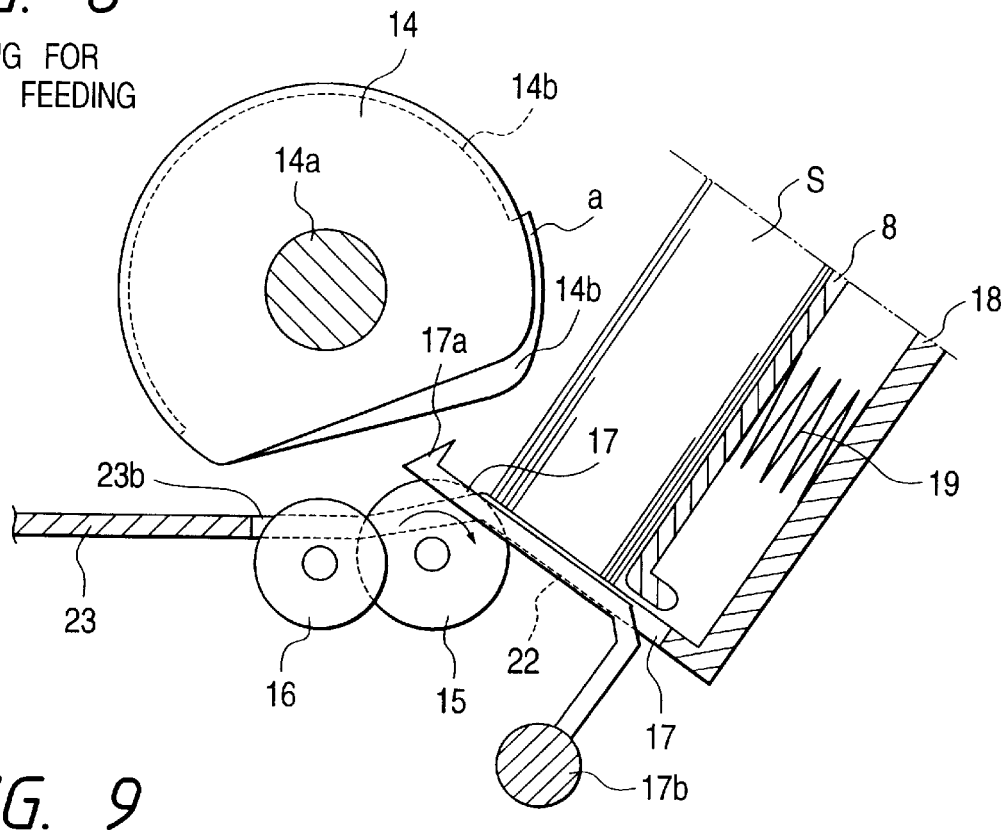
FIG. 8 is a view showing a waiting for paper (sheet) feeding in a one recording sheet separating/feeding operation.
Figure 10:
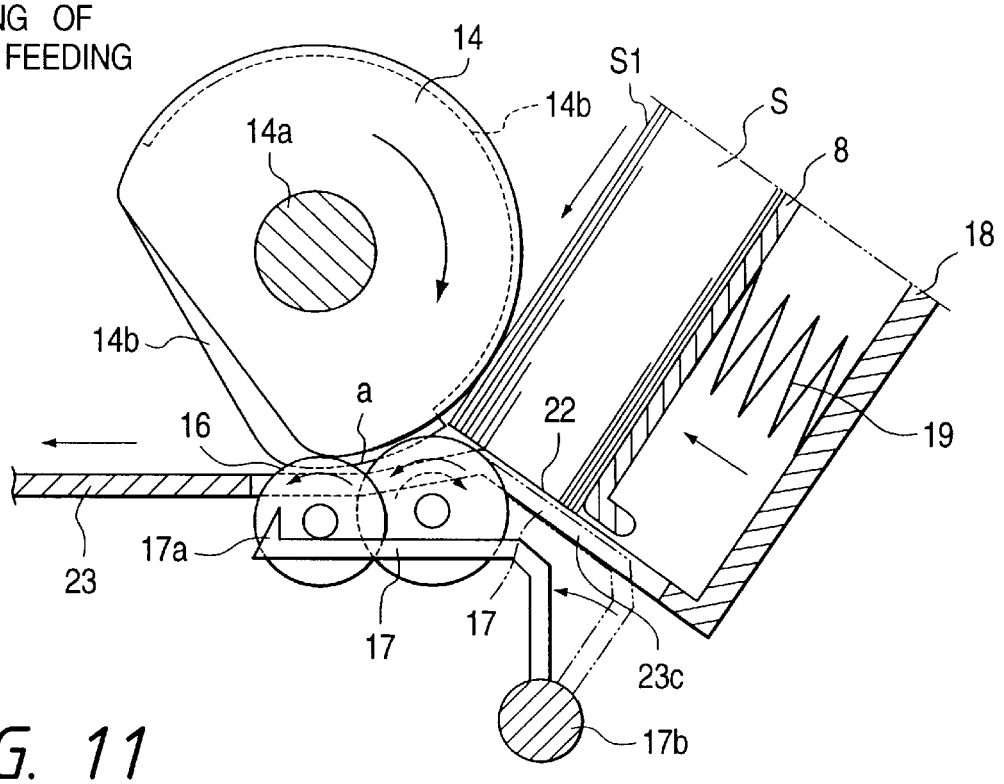
FIG. 10 is a view showing starting of the paper feeding in the one recording sheet separating/feeding operation.

When the lever shaft 17*b* is rotated in the normal direction, the pair of left and right recording sheet return levers 17 assume a first posture condition in which the levers are positioned in the through holes in the abutment plate 22 to be substantially flush with the abutment plate 22 and the pawl portions 17*a* protrude from the upper edge of the abutment plate 22 above the recording sheet convey guide 23, as shown in FIG. 8. When the lever shaft 17*b* is rotated in the revedrse direction, the pair of left and right recording sheet return levers 17 assume a second posture condition in which the levers are retracted below the recording sheet convey guide 23 to retard the pawl portions 17*b* from the upper side to the lower side of the recording sheet convey guide 23, as shown in FIG. 10.

When the recording sheet return levers 17 are in the first posture condition, the levers can position the tip ends of the recording sheets S set on the recording sheet tray 8. The recording sheet setting operation may be a setting operation in which a plurality of recording sheets S are rested on the recording sheet tray 8 or may be a manual insertion setting operation in which a recording sheet different from the recording sheet S is manually inserted onto the recording sheet tray. The recording sheet return levers 17 can be used in both setting operations.

If the return levers 17 are shifted to the second posture condition before the sheet feed roller 14 abuts against the recording sheet stack S, the recording sheets S are bundle-conveyed between the sheet feed roller 14 and the friction separation roller 15 to cause the poor separation. To avoid this, the return levers 17 are shifted to the second posture condition after the sheet feed roller 14 abuts against the recording sheet stack S. This timing can be appropriately adjusted by a cam provided in a drive mechanism which will be described later.

Now, the drive mechanism for shifting the recording sheet return levers 17 and for lifting/lowering the recording sheet tray 8 will be explained.

Figure 16A:
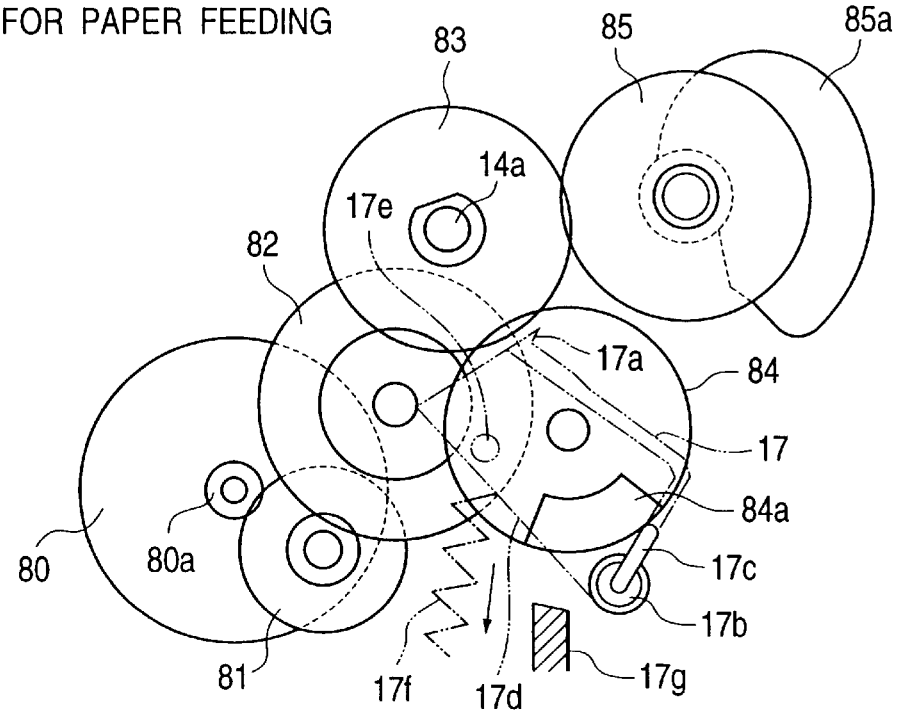
FIGS. 16A and 16B are views showing an example of a drive mechanism for a return lever.
Figure 16B:
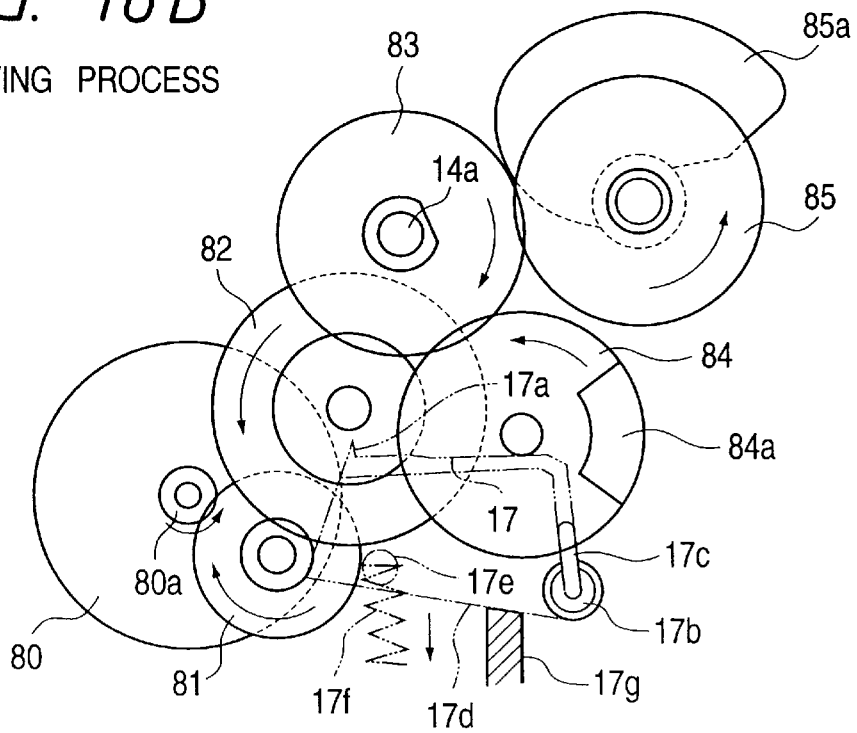

In FIGS. 16A and 16B, the drive mechanism includes a drive motor 80, a motor gear (drive gear) 80*a* secured to a motor shaft of the drive motor, and a sheet feed roller gear 83 secured to the sheet feed shaft 14*a*. The motor gear 80*a* is connected to the sheet feed roller gear 83 through connection gears 81, 82 so that the rotation of the motor gear 80*a* is transmitted to the sheet feed roller gear 83 with predetermined speed reduction.

A lever gear 84 and a recording sheet tray gear 85 are meshed with the sheet feed roller gear 83. The sheet feed roller gear 83, lever gear 84 and recording sheet tray gear 85 have the same number of teeth so that one rotation of the sheet feed roller gear 83 causes corresponding one rotations of the lever gear 84 and recording sheet tray gear 85. An arcuate cam portion 84*a* is integrally formed with a side surface of the lever gear 84, and a tray cam (tray hold-down member) 85*a* is integrally formed with the recording sheet tray gear 85.

A lever shaft shift member 17*c* is formed from a cam follower secured to the lever shaft 17*c* to which the recording sheet return levers 17 are also secured. A vane plate 17*d* is secured to the lever shaft 17*b*, and a lever spring 17*f* disposed between a spring hook portion 17*e* of the vane plate 17*d* and a spring hook portion of the fixed member (not shown). Thus, the lever shaft 17*b* and accordingly the recording sheet return levers 17 are always biased toward an anticlockwise direction by a pulling force of the lever spring 17*f*.

FIG. 16A shows a paper feeding waiting condition in which the drive motor 80 is turned OFF and the gear train 81 to 85 is stopped.

In this waiting condition, the sheet feed roller gear 83 is stopped at an angular position where the semi-circular sheet feed roller 14 and the sheet feed roller ribs 14*b* are positioned so that the cutted flat portions thereof are directed downwardly to separate the sheet feed roller 14 from the underlying friction separation roller 15 and auxiliary rollers 16, as shown in FIG. 8.

The lever gear 84 is stopped at an angular position where the arcuate cam portion 84*a* is directed downwardly. In this condition, the arcuate cam portion 84*a* is contacted with the lever shaft shift member 17*c* to hold the latter so that the recording sheet return levers 17 is held at the first posture condition in opposition to the pulling force of the lever spring 17*f* (i.e., as shown in FIG. 8, the levers become substantially flush with the abutment plate 22 and the pawl portions 17*a* are protruded from the upper edge of the abutment plate 22 above the upper surface of the recording sheet convey guide 23).

The recording sheet tray gear 85 is stopped at an angular position where the protruded portion 85*b* of the tray cam 85*a* is directed downwardly. In this condition, the recording sheet tray 8 is pushed downwardly by the protruded portion 85*b* of the tray cam 85*a* in opposition to the biasing springs 19 to a predetermined waiting position (regulated condition position) as shown in FIG. 8. The sheet feed roller 14 and the sheet feed roller ribs 14*b* are spaced apart from the upper surface of the recording sheet stack S rested on the recording sheet tray 8.

FIG. 16B shows a condition during process. When the sheet feed start signal is inputted to the control circuit, the drive motor 80 is turned ON to rotate the motor gear 80*a*, thereby rotating the gear train 81 to 85 in directions shown by the arrows.

When the sheet feed roller gear 83 is rotated, the sheet feed shaft 14*a* and accordingly the sheet feed roller start to rotate in the sheet feeding direction.

When the lever gear 84 is rotated, in the initial phase of rotation of the gear 84, the lever shaft shift member 17*c* is released from the arcuate cam 84*a*, with the result that the lever shaft 17*b* and accordingly the recording sheet return levers 17 are rotated in the anti-clockwise direction by the pulling force of the lever spring 17*f* until the vane plate 17*d* abuts against a lever stopper 17*g*, thereby reaching the second posture condition where the levers 17 are retracted below the recording sheet convey guide 23 and the pawl portions 17*a* are retarded from the upper side to the lower side of the recording sheet convey guide 23 to open the recording sheet convey path, as shown in FIG. 10.

Figure 9:
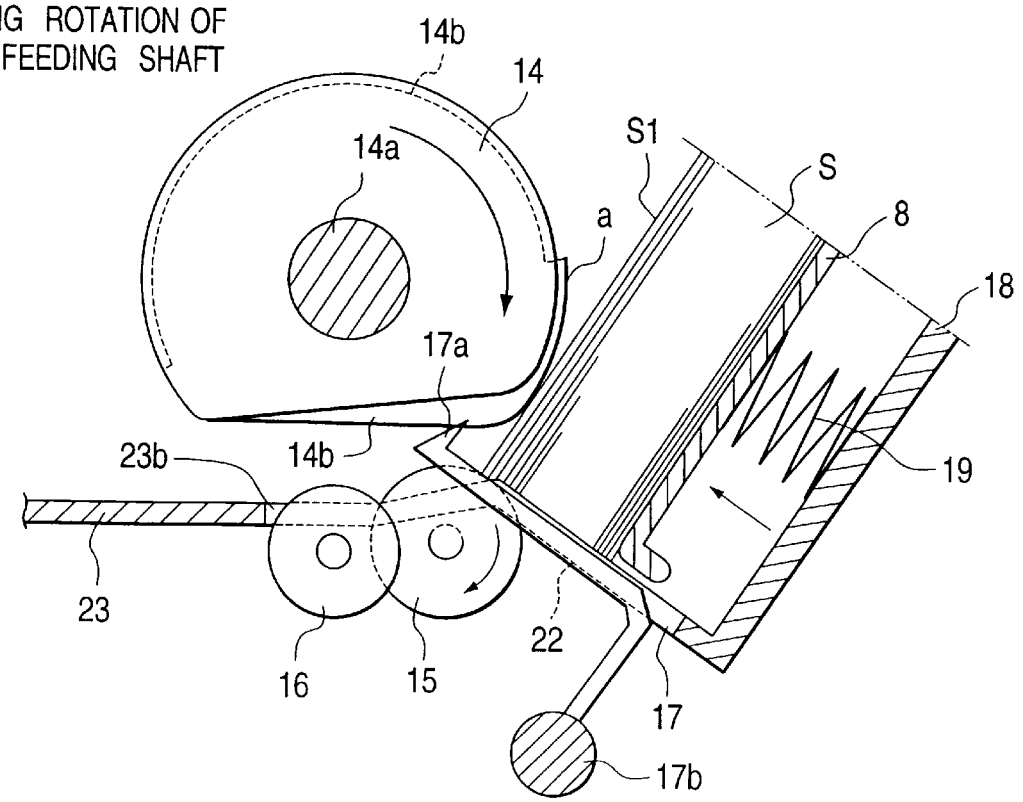
FIG. 9 is a view showing starting rotation of a paper feeding shaft in the one recording sheet separating/feeding operation.

When the recording sheet tray gear 85 is rotated, in the initial phase of rotation of the gear 85, the recording sheet tray 8 is released from the protruded portion 85*b* of the tray cam 85*a* by the rotation thereof, with the result that the recording sheet tray 8 is rocked upwardly around the hinge portion 8*b* by the biasing springs 19 to urge the upper front surface of the recording sheet stack S on the tray against start end portions of protruded rotation zones a of the sheet feed roller ribs 14*a*, as shown in FIG. 9.

In the above condition, the single sheet separating and feeding operation is performed.

Although not shown, there is provided a means (for example, a slit member and a photo-interrupter) for detecting the rotation of the sheet feed roller gear 83. The one rotation of the sheet feed roller gear 83 and accordingly the sheet feed roller 14 is detected by this rotation detecting means, and the rotation of the drive motor 80 is stopped on the basis of a signal from the rotation detecting means.

That is to say, in the illustrated embodiment, the one rotation intermittent drive control of the sheet feed roller 14 is effected by ON/OFF control of the drive motor 80.

In synchronous with the one rotation intermittent rotation of the sheet feed roller gear 83, the lever gear 84 and the recording sheet tray gear 85 are intermittently rotated by one rotation.

Immieditely before the one rotation of the lever gear 84 is completed, the arcuate cam portion 84*a* is contacted with the lever shaft shift member 17*c* on the lever shaft 17*b* again to hold the lever shaft shift member 17*c*, with the result that the lever shaft 17*b* is rotated in the clockwise direction in opposition to the pulling force of the lever spring 17*f*, thereby switching the recording sheet return levers 17 from the second posture condition to the first posture condition.

On the way of one rotation of the recording sheet tray gear 85, the tray cam 85*a* is contacted with the recording sheet tray 8 again, with the result that the recording sheet tray 8 is pushed downwardly in opposition to the biasing springs 19 to the predetermined waiting position.

When the drive motor 80 is stopped after the sheet feed roller gear 83 is rotated by one rotation, the drive system is returned to the paper feeding waiting condition again for waiting for a next sheet feed start signal.

Figure 17A:
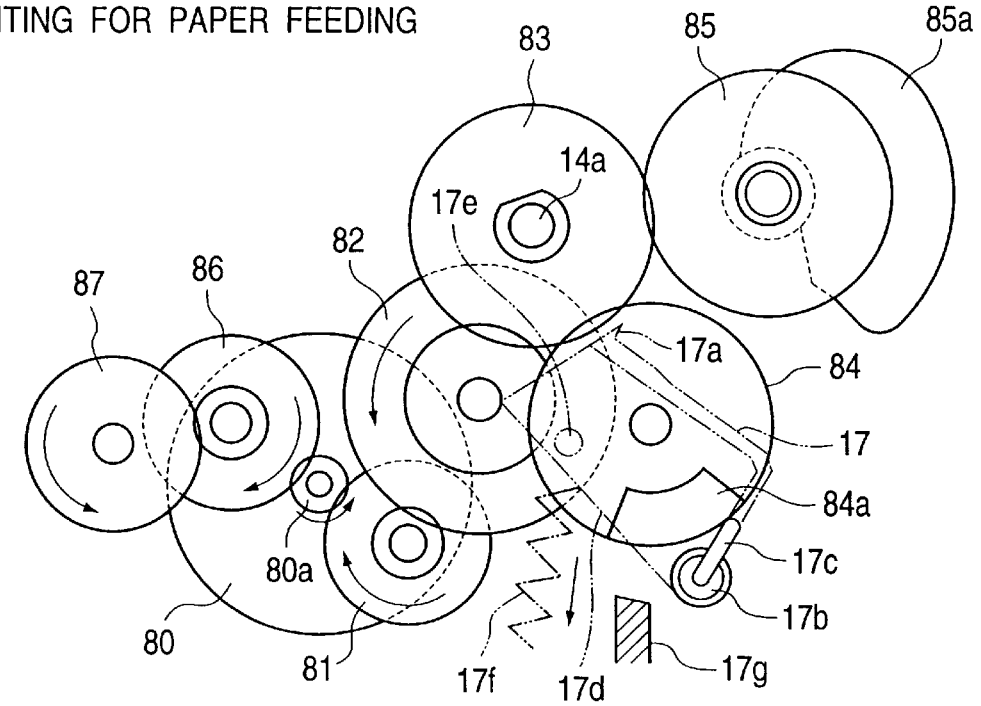
FIGS. 17A and 17B are views showing another example of a drive mechanism for a return lever.
Figure 17B:
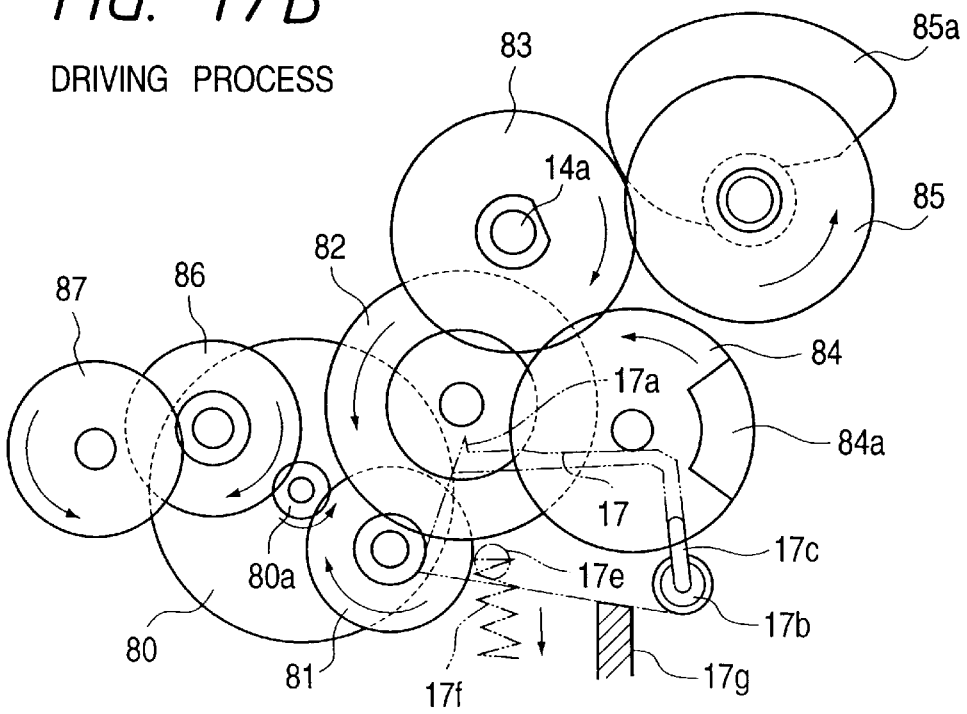

Another example is shown in FIGS. 17A and 17B. The same constructural elements as those of the above-mentioned drive mechanism are designated by the same reference numerals and explanation thereof will be omitted.

In this example, the drive motor 80 is always rotated.

Further, the connection gear 82 can be shifted along a central shaft thereof in a thrust direction, and the thrust shifting of the connection gear 82 is controlled by a thrust shift means including an electromagnetic solenoid (not shown) to act the connection gear 82 as a clutch gear engaged or disengaged (cluth ON/OFF) with respect to the sheet feed roller gear 83.

Although not shown, as is in the arrangement shown in FIGS. 16A and 16B, there is provided a means (for example, a slit member and a photo-interrupter) for detecting the rotation of the sheet feed roller gear 83. The one rotation of the sheet feed roller gear 83 and accordingly the sheet feed roller 14 is detected by this rotation detecting means, and the thrust shift means is clutched OFF on the basis of a signal from the rotation detecting means, thereby stopping the sheet feed roller gear 83 and the associated gears.

That is to say, in this example, the one rotation intermittent drive control of the sheet feed roller 14 is effected by the engagement and disengagement control of the connection gear 82 with respect to the sheet feed roller gear 83.

Gears 86, 87 serve to transmit a driving force to recording sheet relay convey rollers disposed at a downstream side of the sheet feed roller 14 and are connected to the motor gear 80*a* of the drive motor 80.

FIG. 17A shows a paper feeding waiting condition. In this condition, the drive motor 80 is rotated and the thrust shift means for the connection gear 82 is clutched OFF to disengage the connection gear 82 from the sheet feed roller gear 83.

Accordingly, in this waiting condition, the gears 86, 87 for transmitting the driving force to the recording sheet relay convey rollers disposed at the downstream side of the sheet feed roller 14 are rotated and the connection gears 81, 82 are rotated, and the sheet feed roller gear 83, lever gear 84 and recording sheet tray gear 85 are stopped, with the result that the sheet feed rolelr 14, recording sheet return levers 17 and recording sheet tray 8 are held at a condition same as the above-mentioned paper feeding waiting condition.

FIG. 17B shows a condition during process. In this condition, when the sheet feed start signal is inputted to the control circuit, the thrust shift means for the connection gear 82 is clutched ON to engage the connection gear 82 by the sheet feed roller gear 83.

As a result, the sheet feed roller gear 83, lever gear 84 and recording sheet tray gear 85 start to rotate, thereby performing the single sheet separating and feeding operation.

When the one rotation of the sheet feed rolelr gear 83 and accordingly the sheet feed roller 14 is detected by the rotation detecting means, the thrust shift means for the connection gear 82 is clutched OFF to disengage the connection gear 82 from the sheet feed roller gear 83, thereby returning the drive system to the paper feeding waiting condition shown in FIG. 17A for preparing a next sheet feed start signal.

Next, the sheet feed roller ribs 14*b* will be explained with reference to FIGS. 7A and 7B. The sheet feed roller ribs 14*b* are secured to the sheet feed shaft 14*a* on both sides of the semi-circular sheet feed roller 14. Each sheet feed roller rib 14*b* comprises a semi-circular plate member having substantially the same shape as the sheet feed roller 14 and is secured to the sheet feed shaft 14*a* with substantially the same angular phase as that of the sheet feed roller 14. The sheet feed roller 14 is formed from friction rubber material to frictionally convey the recording sheet contacted with the roller; whereas, the sheet feed roller ribs 14*b* are formed from low friction material (for example, metal) to permit slip between the ribs and the recording sheet contacted with the ribs.

Further, a diameter of each sheet feed roller rib 14*b* is selected so that a diameter R(B) of a predetermined angular region an opposed to the recording sheet stack S on the recording sheet tray 8 in the initial rotation phase of the sheet feed roller rib 14*b* becomes greater than a diamter R(A) of the cylindrical portion of the sheet feed roller 14 and a diameter R(C) of the remaining portion of the sheet feed roller rib 14*b* becomes smaller than or equal to the diameter R(A) of the cylindrical portion of the sheet feed roller 14. The predetermined angular regions a of the sheet feed roller ribs 14*b* having the diameters R(B) greater than the diameter R(A) of the cylindrical portion of the sheet feed roller 14 constitute slip regions for the sheet feed roller 14. b) Single Sheet Separating and Feeding Operation FIGS. 8 to 14 show time-lapse sequences of the single sheet separating and feeding operation during the one rotation intermittent rotations of the sheet feed roller 14 and the sheet feed roller ribs 14*b*.

FIG. 8 shows the paper feeding waiting condition. In this waiting condition, the one rotation clutch mechanism (not shown) for the sheet feed shaft 14*a* is turned OFF to hold the sheet feed shaft 14*a* in the stopped condition and to hold the sheet feed roller 14 and the sheet feed roller ribs 14*b* so that the cutted flat portions thereof are directed downwardly to separate the sheet feed roller 14 from the underlying friction separation roller 15 and auxiliary rollers 16.

The recording sheet tray 8 is pushed downwardly to the predetermined waiting condition by the tray cam 85*a* synchronous with the rotation of the sheet feed shaft 14*a* in opposition to the biasing springs 19 to separate the sheet feed roller 14 and the sheet feed roller ribs 14*b* from the upper surface of the recording sheet stack S rested on the recording sheet tray 8.

The pair of left and right recording sheet return levers 17 are held in the first posture condition in which the levers are positioned within the through holes in the abutment plate 22 to be substantially flush with the abutment plate 22 and the pawl portions 17*a* are protruded from the upper edge of the abutment plate 22 above the upper surface of the recording sheet convey guide 23. In such a condition that the pawl portions 17*a* are protruded from the upper edge of the abutment plate 22 above the upper surface of the recording sheet convey guide 23, when the recording sheets S are set or replenished on the recording sheet tray 8 or when the recording sheet is manually inserted onto the recording sheet tray, the tip end of the recording sheet or sheet stack is prevented from entering between the sheet feed roller 14 and the friction separation roller 15 which are now separated from each other.

In the illustrated embodiment, as mentioned above, the friction separation roller 15 is constituted by the so-called retard roller rotated in the recording sheet returning direction via the torque limiter (not shown). The auxiliary rollers 16 are rotated freely.

FIG. 9 shows an initial condition after the sheet (paper) feed shaft starts to rotate. In the waiting condition shown in FIG. 8, when the sheet feed start signal is inputted to the control circuit, the one rotation clutch mechanism (not shown) of the sheet feed shaft 14*a* is turned ON to start one rotation of the sheet feed shaft 14*a* in the sheet feeding direction. That is to say, the semi-circular sheet feed roller 14 and the sheet feed roller ribs 14*b* start to rotate in the sheet feeding direction (clockwise direction) by one rotation.

At the same time, the recording sheet tray 8 is released from the tray cam 85*a* synchronous with the rotation of the sheet feed shaft 14*a*, with the result that the recording sheet tray 8 is rocked upwardly around the hinge portion 8*b* by the biasing springs 19 to urge the upper front surface of the recording sheet stack S rested on the tray against the start end of the large diameter rotation angle regions a of the sheet feed roller ribs 14*b*.

FIG. 10 shows a condition that the sheet (paper) feeding is started. From the condition shown in FIG. 9, when the sheet feed roller 14 and the sheet feed roller ribs 14*b* are further rotated until the large diameter rotation angle regions a of the sheet feed roller ribs 14*b* pass through the upper front surface of the recording sheet stack S rested on the recording sheet tray 8, the cylindrical portion of the sheet feed roller 14 corresponding to the large diameter rotation angle regions a of the sheet feed roller ribs 14*b* does not contact with the upper front surface of the recording sheet stack S rested on the recording sheet tray 8 because the regions a of the ribs 14*b* act as spacers, and the large diameter rotation angle regions a of the sheet feed roller ribs 14*b* rotatingly slip on the upper front surface of the recording sheet stack S rested on the recording sheet tray 8, with the result that the uppermost recording sheet S1 in the recording sheet stack S is not fed out.

However, after the large diameter rotation angle regions a of the sheet feed roller ribs 14*b* pass through the upper front surface of the recording sheet stack S rested on the recording sheet tray 8, the cylindrical portion of the sheet feed roller 14 is contacted with the upper front surface of the recording sheet stack S rested on the recording sheet tray 8 with predetermined pressure. From this point, the uppermost recording sheet S1 starts to be fed out by the friction contact of the sheet feed roller 14.

At the same time, the lever shaft 17*b* is released from the arcuate cam 84 synchronous with the rotation of the sheet feed shaft 14*a*, with the result that the lever shaft 17*b* is rotated by the lever spring 17*f* by a predetermined amount to switch the recording sheet return levers 17 to the second posture condition where the recording sheet return levers 17 are retracted below the recording sheet convey guide 23 and the pawl portions 17*a* are retarded from the upper side to the lower side of the recording sheet convey guide 23.

Further, at this time, the cylindrical portion of the sheet feed roller 14 corresponding to the large diameter rotation angle regions a of the sheet feed roller ribs 14*b* reaches the friction separation roller 15 and the auxiliary rollers 16 to contact with these rollers, with the result that the friction separation roller 15 and the auxiliary rollers 16 are rotatingly driven by the rotation of the sheet feed roller 14.

That is to say, the friction separation roller 15 is rotatingly driven by the rotation of the sheet feed roller 14 before the tip end of the recording sheet reaches the separation portion.

In this way, in the starting of the sheet feeding, since the sheet feed roller 14 has already been contacted with the friction separation roller 15 and the auxiliary rollers 16 to drivingly rotate the friction separation roller 15 and the auxiliary rollers 16, the tip end of the uppermost recording sheet S1 fed by the friction contact of the sheet feed roller 14 can smoothly enter into a nip (separation portion) between the rotating sheet feed roller 14 (having the rotation driving force in the recording sheet conveying direction) and the rotating friction separation roller 15. Thus, even when the resiliency of the recording sheet is small, the recording sheet is not blocked by the nip. Accordingly, the buckling of the tip end portion of the recording sheet does not occur, thereby preventing the deterioration of the recording sheet such as folding or shrinking of the tip end and the poor conveyance.

Figure 11:
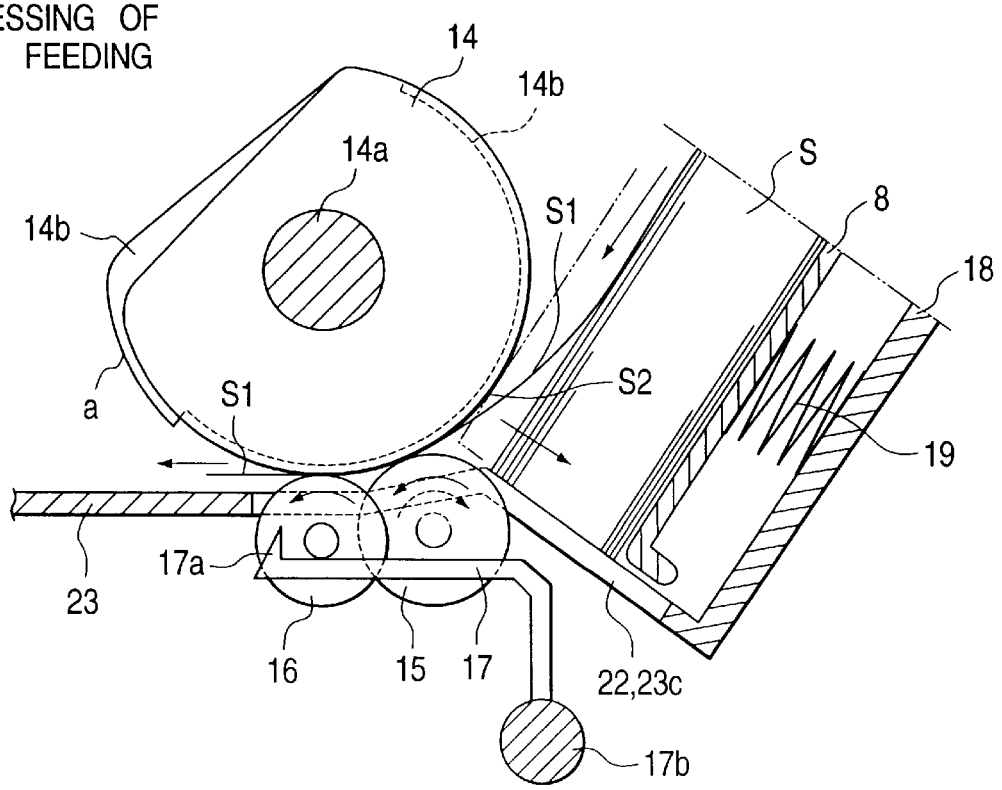
FIG. 11 is a view showing processing of the paper feeding in the one recording sheet separating/feeding operation.
Figure 12:
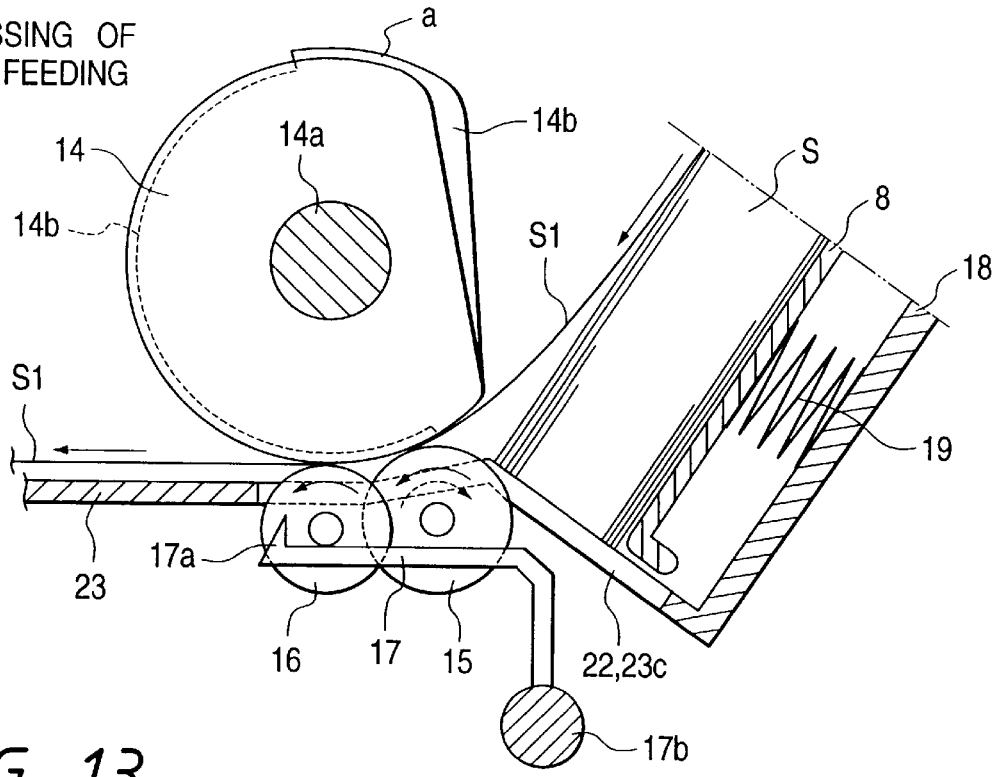
FIG. 12 is a view showing further processing of the paper feeding in the one recording sheet separating/feeding operation.

FIGS. 11 and 12 show conditions during the processing of the sheet (paper) feeding. The uppermost sheet S1 fed out by the sheet feed roller 14 as shown in FIG. 10 enters into the nip between the cylindrical portion of the sheet feed roller 14 and the friction separation roller 15 and is pinched by the nip and then is pinched by a nip between the sheet feed roller 14 and the auxiliary rollers 16. In this way, the recording sheet is conveyed.

As the uppermost recording sheet S1 is supplied, even if the second and other recording sheets enter into the nip between the sheet feed roller 14 and the friction separation roller 15 together with the uppermost recording sheet S1, the second and other recording sheets are returned by the friction separation roller 15 acting as the retard roller. Thus, the double-feed of the recording sheets can be prevented, and only the uppermost recording sheet S1 is pinched and conveyed by the nip between the sheet feed roller 14 and the friction separation roller 15 and then is pinched and conveyed by the nip between the sheet feed roller 14 and the auxiliary rollers 16 to the recording system C.

Since the recording sheet return levers 17 were switched to the second posture condition to be retracted below the recording sheet convey guide 23, the uppermost recording sheet S1 is not blocked by the recording sheet return levers 17.

When a predetermined time period is elapsed after the tip end of the uppermost recording sheet S1 reached the nip between the sheet feed roller 14 and the friction separation roller 15 and the nip between the sheet feed roller 14 and the auxiliary rollers 16, the recording sheet tray 8 is lowered again to the predetermined waiting position in opposition to the biasing springs 19 by the cam (not shown) in synchronous with the rotation of the sheet feed shaft 14*a*. FIG. 11 shows a condition that the recording sheet tray 8 is lowered again to the predetermined waiting position.

In this way, when the recording sheet tray 8 is lowered again to the predetermined waiting position, although the rotating sheet feed roller 14 is separated from the recording sheet stack S, the fed-out uppermost recording sheet S1 is further conveyed stably while being pinched by the nips between the sheet feed roller 14 and the friction separation roller 15 and the auxiliary rollers 16.

The conveyance of the uppermost recording sheet S1 by the nip between the sheet feed roller 14 and the friction separation roller 15 and the nip between the sheet feed roller 14 and the auxiliary rollers 16 continues until the finish end portion of the cylindrical portion of the sheet feed roller 14 leaves the friction separation roller 15 and the auxiliary rollers 16 as the one rotation drive of the sheet feed roller 14 proceeds. Meanwhile, the double-feed of the second and other recording sheets is prevented.

As the one rotation drive of the sheet feed rolelr 14 proceeds, when the finish end portion of the cylindrical portion of the sheet feed roller 14 leaves the friction separation roller 15 and the auxiliary rollers 16, the tip end of the uppermost recording sheet S1 has already reached at least a nip between the LF roller 24 and the pinch roller 26 of the recording system C to continue the stable conveyance of the recording sheet.

Figure 13:
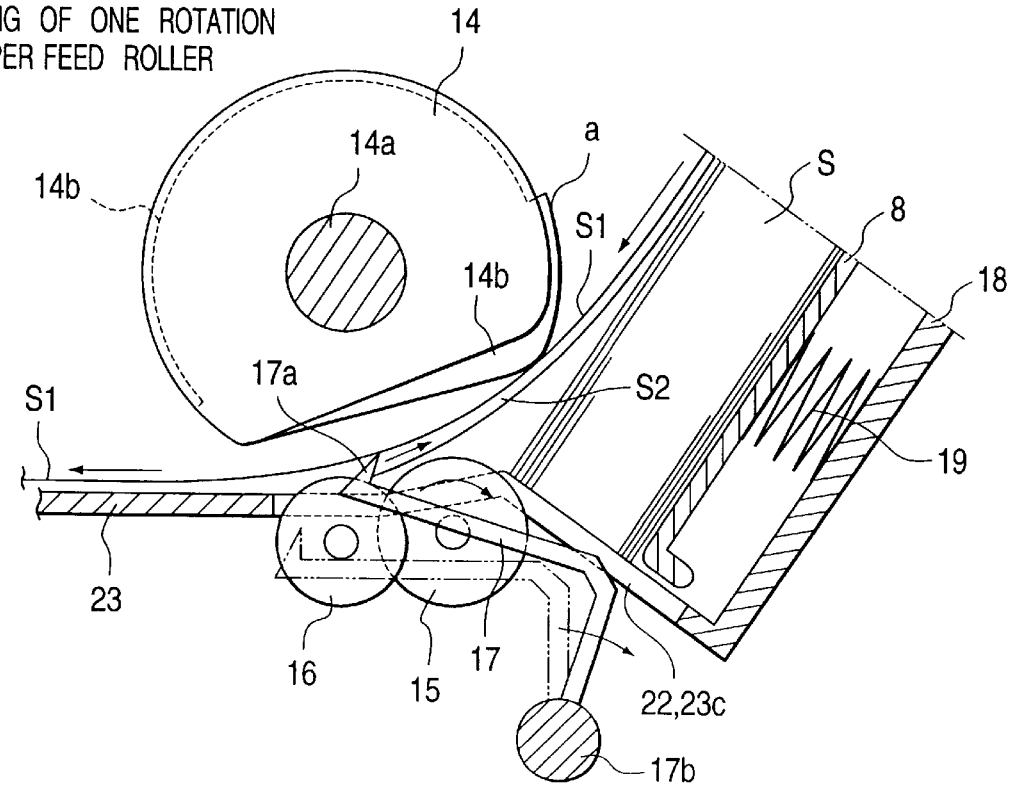
FIG. 13 is a view showing finishing one rotation of the paper feeding roller in the one recording sheet separating/feeding operation.
Figure 14:
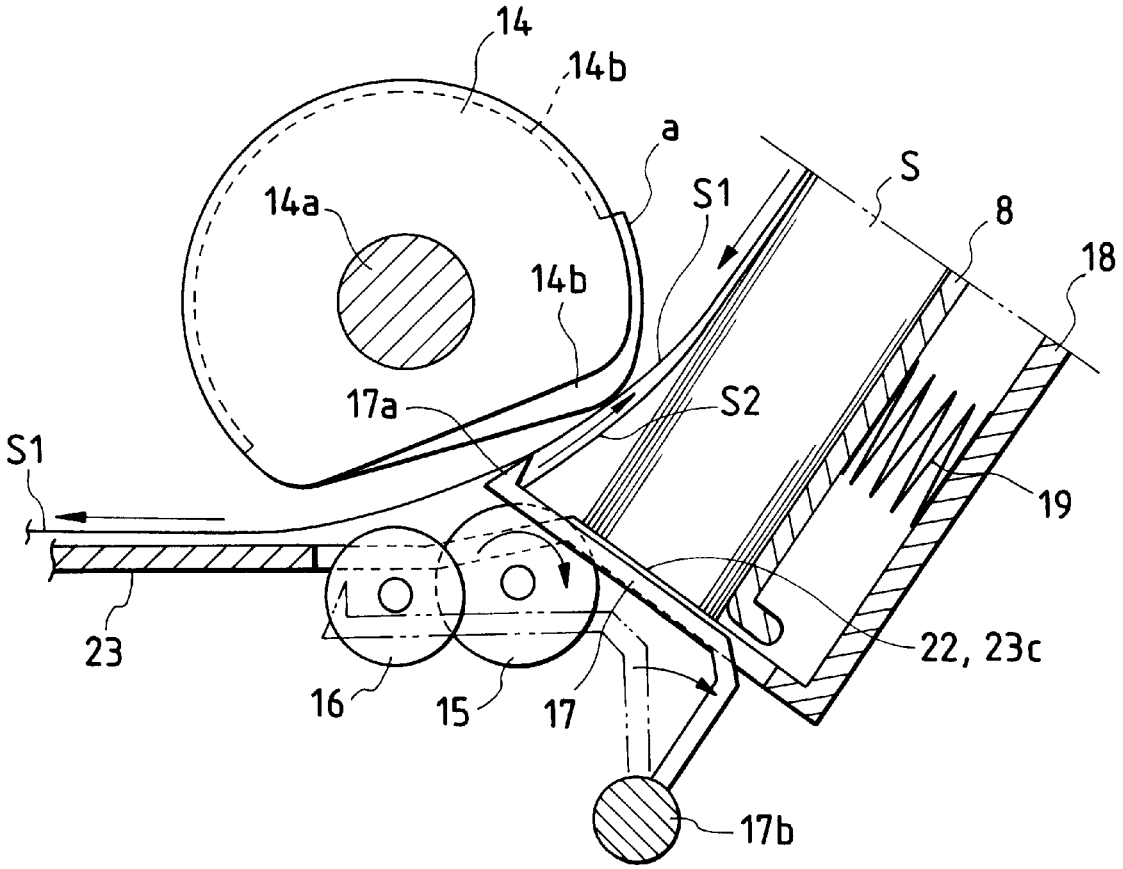
FIG. 14 is a view showing another condition of the finishing one rotation of the paper feeding roller in the one recording sheet separating/feeding operation.

FIGS. 13 and 14 show a condition after the finishing of one rotation of the sheet feed roller. When the sheet feed shaft 14*a* has just rotated by one rotation, the one rotation clutch mechanism is turned OFF, thereby stopping the sheet feed shaft 14*a*. That is to say, the sheet feed roller 14 is returned to the same angular phase position as that in the waiting condition to direct the cutted flat portion downwardly, thereby separating the sheet feed roller 14 from the underlying friction separation roller 15 and auxiliary rollers 16.

In this way, after the one rotation drive of the sheet feed roller 14 is finished, only the tip end of the uppermost recording sheet S1 has already reached at least the nip between the LF roller 24 and the pinch roller 26 of the recoding system C to continue the stable conveyance of the uppermost recording sheet.

Further, the arcuate cam 84*a* synchronous with the rotation of the sheet feed shaft 14*a* abuts against the lever shaft 17*b* to rotate the lever shaft 17*b* in opposition to the elastic force of the lever spring 17*f*, thereby switching the recording sheet return levers 17 from the second posture condition to the first posture condition. FIG. 13 shows a condition on the way of the shifting movement of the recording sheet return levers 17 from the second posture condition to the first posture condition.

On the way of the retating movement of the recording sheet return levers 17 from the second posture condition to the first posture condition, the pawl portions 17*a* protrude through the through holes 23*c* above the recording sheet convey guide 23.

The tip ends of the recording sheet return levers 17 have the pawl portions 17*a* extending in perpendicular to the recording sheet conveying direction, and the rotating tracks or paths of the recording sheet return levers 17 and the pawl portions 17*a* extend up to a position inside (toward a center of the sheet feed roller) of the periphery of the cylindrical portion of the sheet feed roller 14 now feeding the uppermost recording sheet so that, during the rotating movement of the recording sheet return levers 17 from the second posture condition to the first posture condition, the tip ends (pawl portions 17*a*) of the recording sheet return levers 17 act to lift the uppermost recording sheet S1 and to catch the second and other recording sheets (trying to be double-fed) and return the second and other recording sheets toward the recording sheet tray 8.

The recording sheet return levers 17 are finally returned to the first posture condition (as shown in FIG. 14) where the levers are positioned within the through holes of the abutment plate 22 to be substantially flush with the abutment plate 22 and the pawl portions 17*a* are protruded from the upper edge of the abutment plate 22 above the recording sheet convey guide 23.

The recording sheet return levers 17 returned to the first posture condition prevent the double-feed of the second and other recording sheets which may be caused by the movement of the uppermost recording sheet S1. Since the recording sheet S1 being fed is guided while contacting with the sheet feed roller ribs 14*b*, great resistance does not act on the recording sheet.

After the trail end of the uppermost recording sheet S1 being conveyed leaves the sheet feed roller 14, when the next sheet feed start signal is inputted to the control circuit, the same operation cycle as mentioned above is carried out to separate the second or next recording sheet S2 from the recording sheet stack S.

The recording sheet return levers 17 switched between the first and second posture conditions can prevent the double-feed of the recording sheets other than the recording sheet S1 being separated and fed, and, when the levers 17 are returned to the first posture condition, the setting or replenishment of recording sheets on the recording sheet tray 8 can be performed easily and positively and the levers 17 can avoid the deterioration of the recording sheet due to poor conveyance such as double-feed or imperfect feed.

c) Jam Treatment in Sheet Feeding System B

If the recording sheet jam is detected by a jam detection means (not shown) in the sheet feeding system B, the operation of the apparatus is stopped.

Figure 15A:
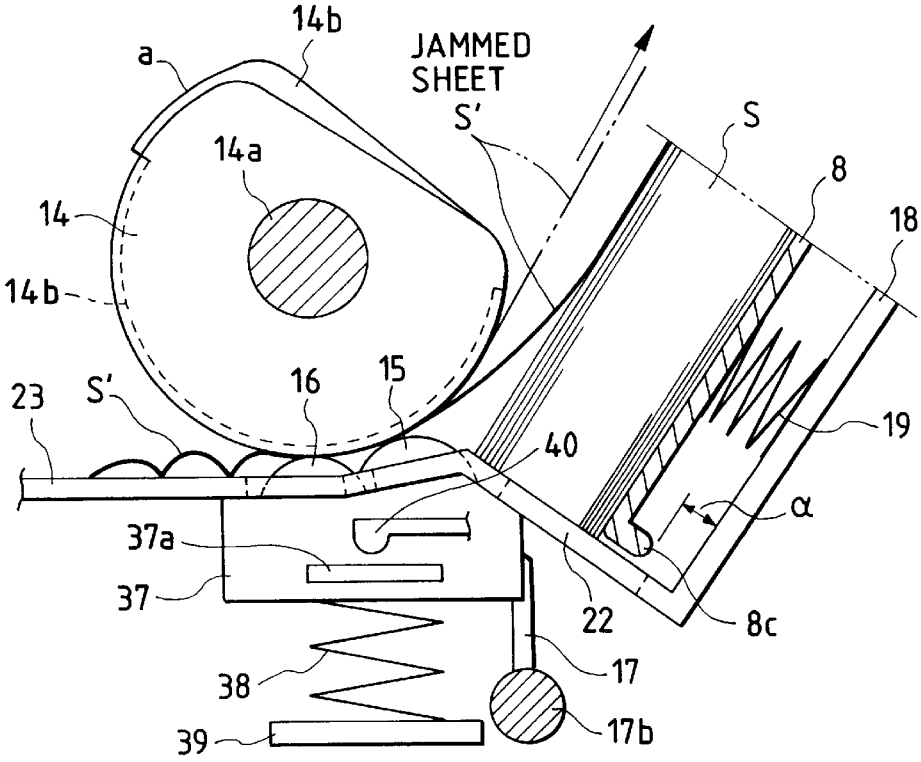
FIGS. 15A and 15B are explanatory views for explaining jam treatment.

FIG. 15A shows a condition that the recording sheet being separated and fed is jammed and the jammed recording sheet S' is pinched by the nips between the cylindrical portion of the sheet feed roller 14 (now stopped) and the friction separation roller 15/auxiliary rollers 16.

In this condition, if the jammed recording sheet S' is tried to be removed by pulling the sheet from the recording sheet tray 8 side, since the biasing forces of the friction separation roller 15 and the auxiliary rollers 16 act on the sheet feed roller 14, a great force is required for removing the jammed recording sheet S' from the nips, and, in the worst case, the jammed recording sheet S' will be torn.

Figure 15B:
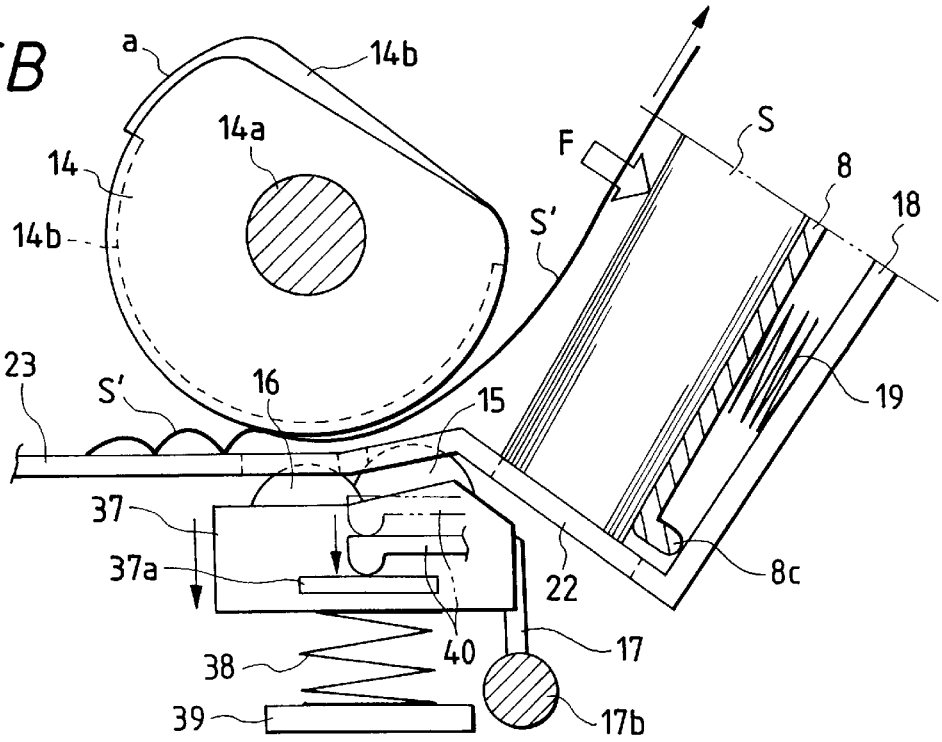

In the apparatus according to the illustrated embodiment, as described in connection with FIGS. 6A and 6B, since the friction separation roller 15 and the auxiliary rollers 16 are incorporated as the unit 37 which can be shifted away from the sheet feed roller 14 in opposition to the biasing spring 38 by the pushing member 40 within the over-stroke range $\alpha$ of the rockable recording sheet tray 8, if the sheet jam occurs, as shown in FIG. 15B, by pushing the upper surface of the recording sheet stack S on the tray 8 downwardly in opposition to the biasing springs 19 by the finger force F, the tray is lowered until the protruded portion 8*c* at the tip end of the tray 8 abuts against the inner surface of the fixed support plate 18, with the result that the pushing member 40 is also lowered to abut against the receiving plate 37*a* of the unit 37, thereby lowering the unit 37 in opposition to the biasing spring 38.

As a result, since the friction separation roller 15 and the auxiliary rollers 16 are separated from the cylindrical portion of the sheet feed roller 14, the condition that the jammed sheet S' is pinched between the cylindrical portion of the stopped sheet feed roller 14 and the friction separation roller 15/auxiliary rollers 16 is released.

Accordingly, in this condition, by pulling out the jammed recording sheet S', the jammed recording sheet S' can easily be removed without any load.

After the jammed recording sheet S' is removed, when the finger force F is released from the recording sheet tray 8, the tray 8 is lifted again by the biasing springs 19 up to the predetermined waiting position, and, in synchronous with this movement, the pushing member 40 is lifted to release the unit 37, with the result that the unit 37 is lifted by the biasing spring 38 to urge the friction separation roller 15 and the auxiliary rollers 16 against the cylindrical portion of the sheet feed roller 14 again.

After the jam treatment, the apparatus is reset to re-start the sheet feeding operation.

(3) Other Embodiments

1) In the illustrated embodiments, while an example that the ink jet recording system is used as the recording means for the recording sheet S was explained, the recording means may be constituted by an electrophotographic recording system (laser beam printer) using toner or a heat transfer recording system using an ink sheet and a thermal head.

2) In the illustrated embodiments, while the levers 17 for preventing the double-feed of the recording sheets were provided, such levers 17 may be omitted.

Figure 18:
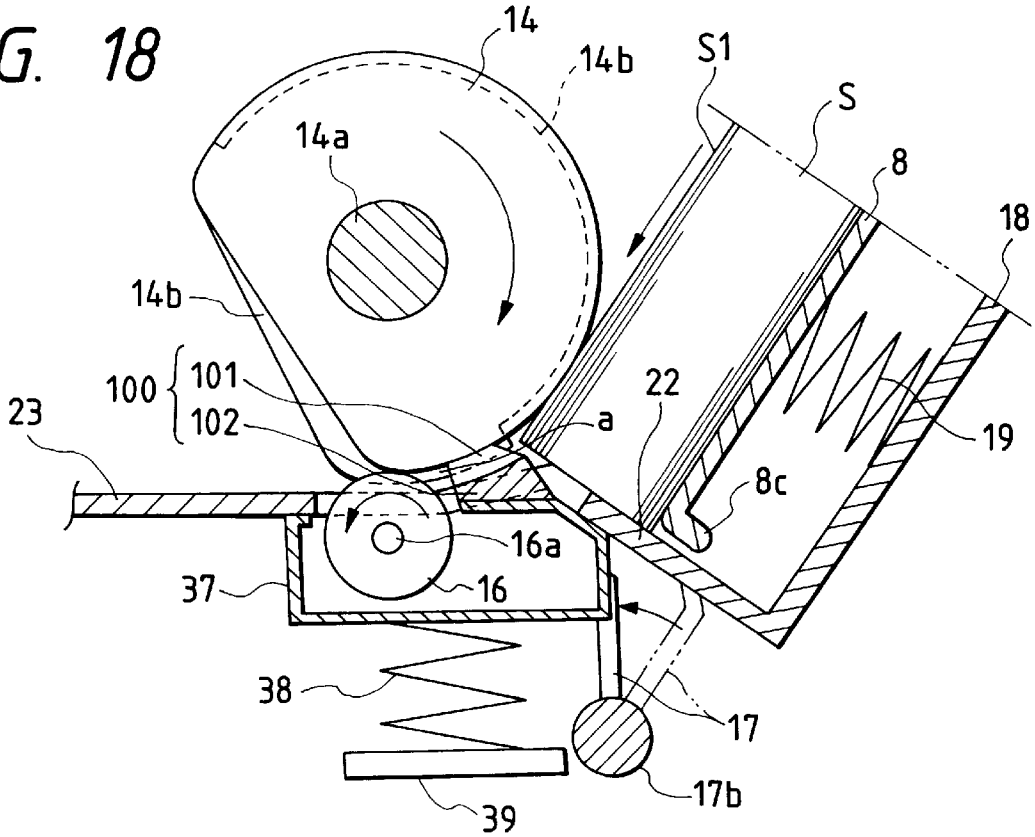
FIG. 18 is a schematic sectional view of a sheet feeding apparatus using a friction and as a separation member.

3) In the illustrated embodiments, while an example that the friction separation roller (retard roller) 15 having the torque limiter is used as the separation member for effecting the separation of the recording sheet was explained, as shown in FIG. 18, a friction pad 100 comprised of a friction portion 101 and a friction portion holder 102 may be used as the separation member for effecting the separation of the recording sheet. In this case, a normal rubber sheet is used as the friction portion 101.

Figure 19:
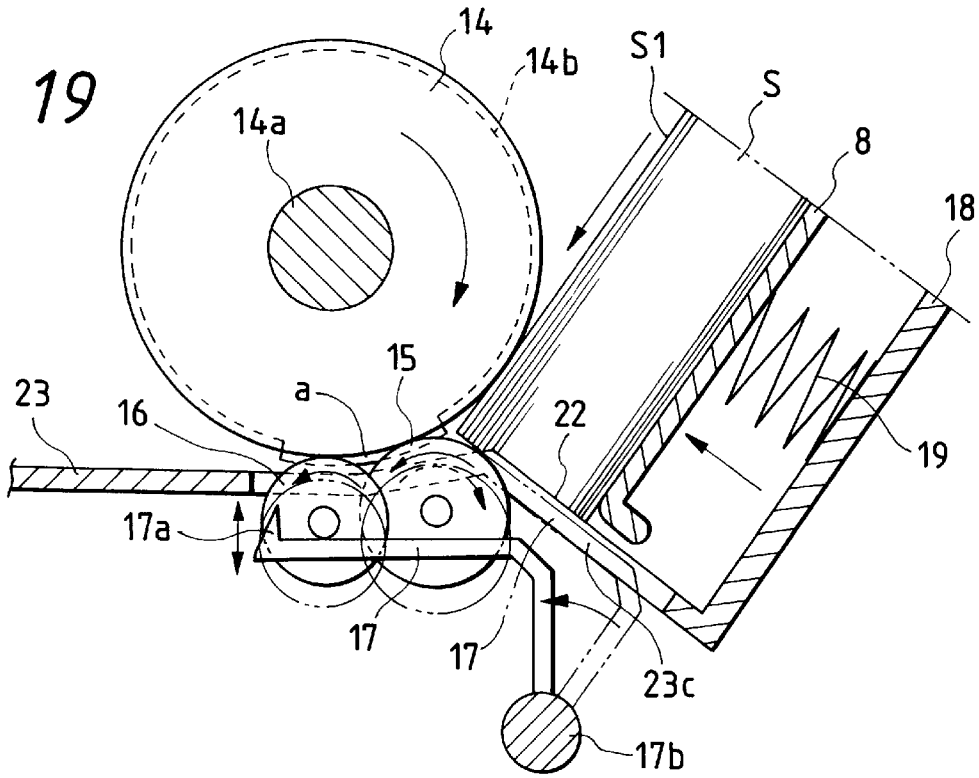
FIG. 19 is a schematic sectional view of a sheet feeding apparatus using a cylindrical roller as a sheet feed roller.
Figure 20A:
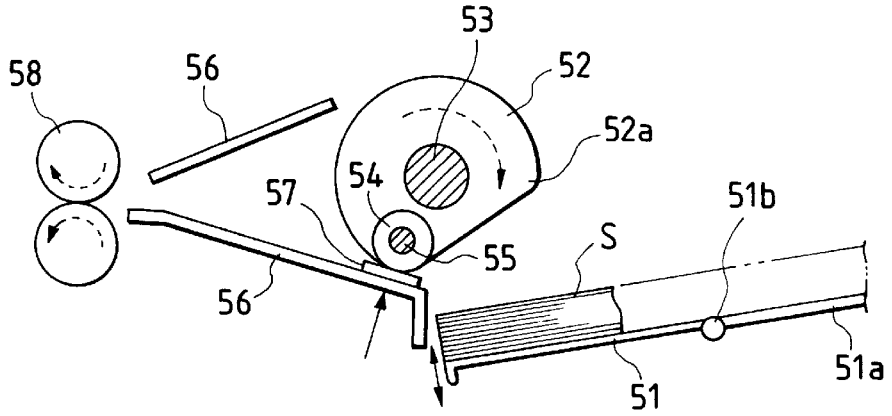
FIG. 20A is a schematic sectional view of a conventional sheet feeding apparatus.
Figure 20B:
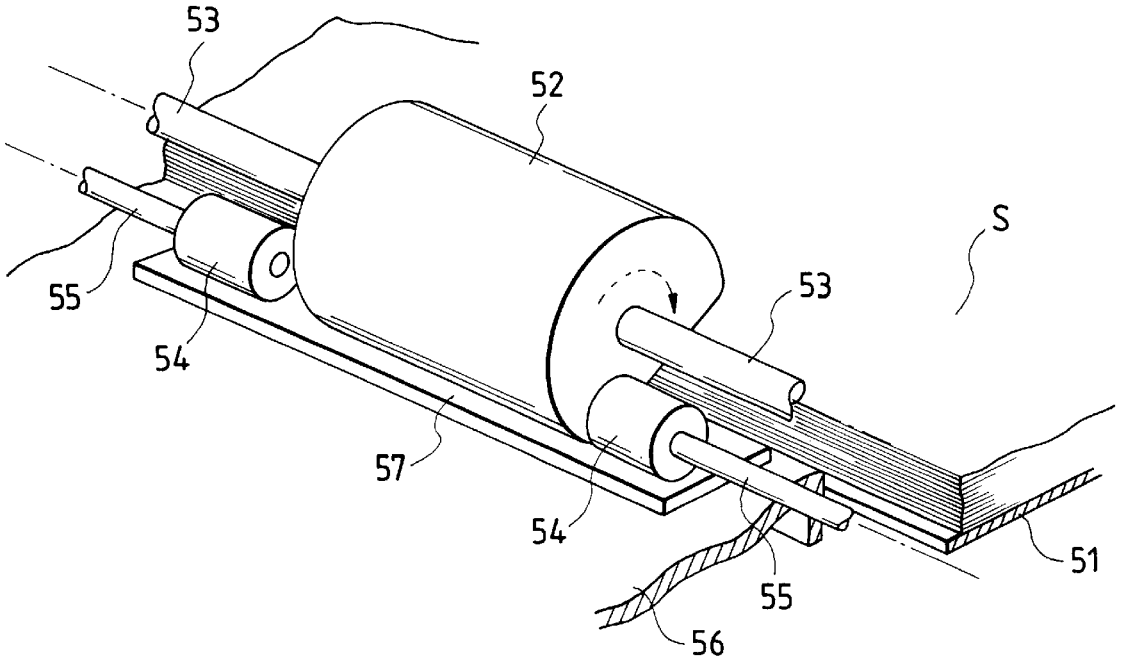
FIG. 20B is a perspective view of the apparatus of FIG. 20A.
Figure 21A:
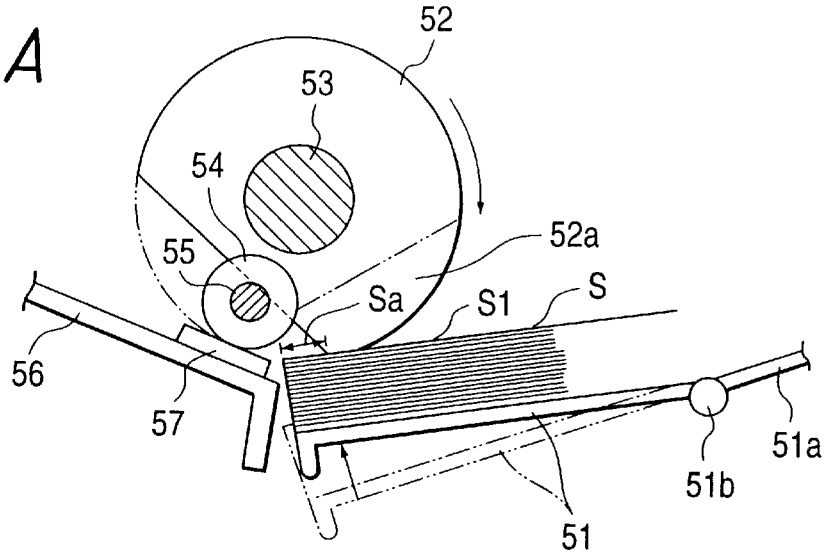
FIGS. 21A to 21C are views showing a one recording sheet separating/feeding operation of the apparatus of FIG. 20A.
Figure 21B:
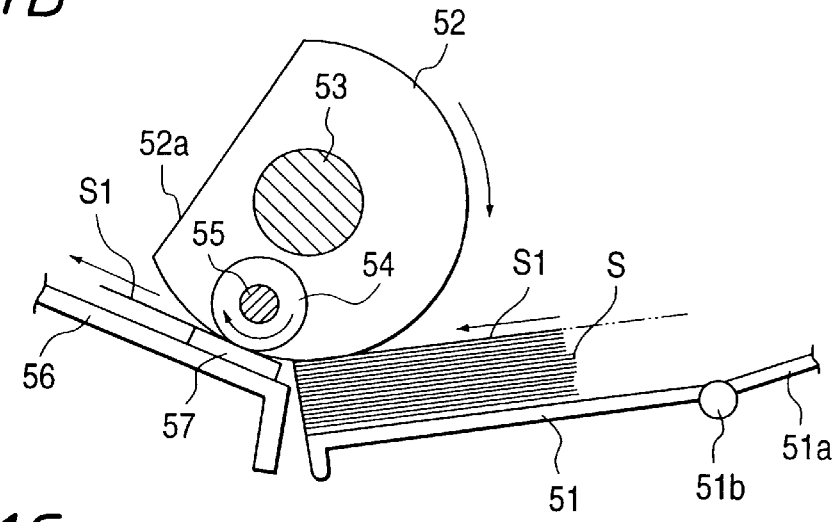
Figure 21C:
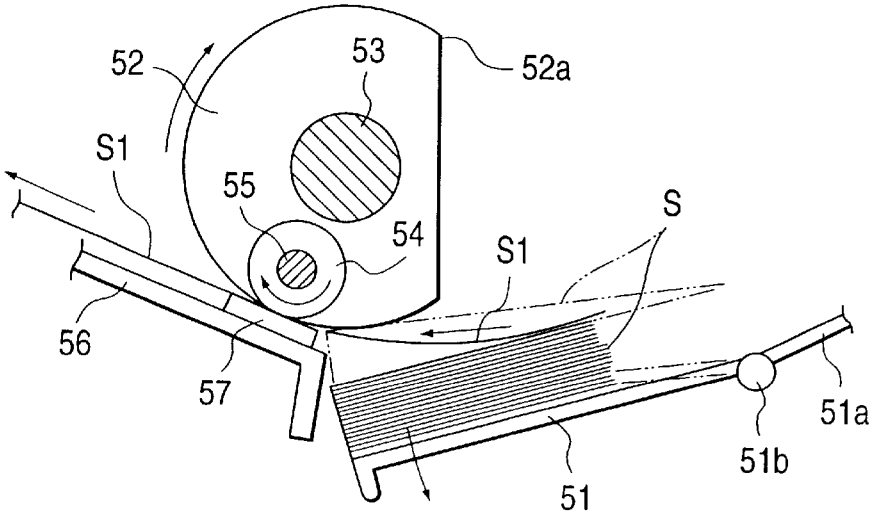
Figure 22A:
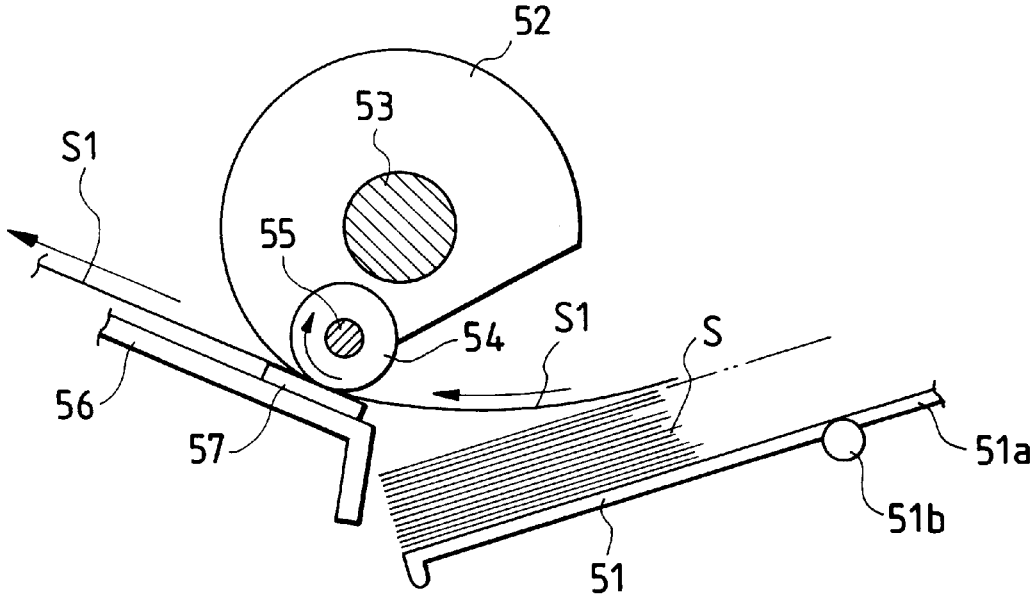
FIG. 22A is a view showing the one recording sheet separating/feeding operation of FIG. 20A.
Figure 22B:
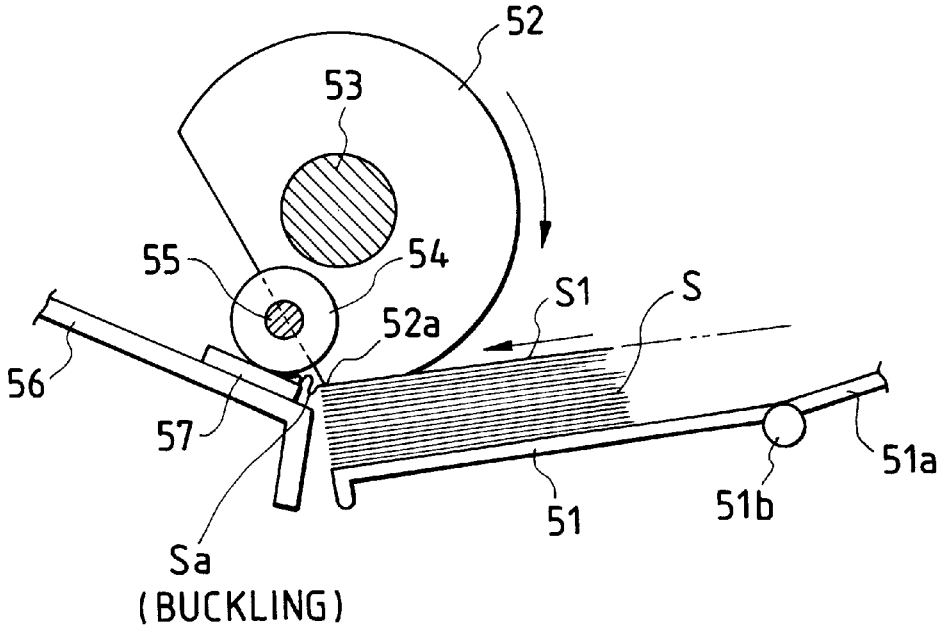
FIG. 22B is a view showing occurrence of buckling of a tip end portion of a recording sheet at a separation portion.

4) In the illustrated embodiments, while an example that the sheet feed roller 14 comprises the semi-circular roller which can be separated from the friction separation roller 15 was explained, as shown in FIG. 19, the friction separation roller 15 and the auxiliary rollers 16 may be separated from a complete cylindrical sheet feed roller in a direction shown by the arrow X. Further, the cylindrical sheet feed roller may be separated from the friction separation roller by a motor and the like.

5) The sheet feeding apparatus according to the present invention is not limited to the illustrated facsimile apparatus, but may be used with another image forming apparatuses such as a copying machine, a laser beam printer, an ink jet printer and the like, or with other sheet using apparatuses.

6) In the image forming apparatus, the sheet may be, for example, a transfer sheet, a recording sheet, a print sheet, an OHP sheet, an original, an envelope, a post card, a card or a film. The material of the sheet is not limited to paper, but may be plastic, metal or cloth.

What is claimed is:

1. A sheet feeding apparatus comprising:

sheet supporting means for supporting sheets;

a feed roller disposed at a downstream side of the sheets supported by said sheet supporting means in a sheet feeding direction to feed out a sheet by rotating;

a separation roller disposed at a downstream side of said sheet supporting means in the sheet feeding direction in a confronting relation to said feed roller, said separation roller rotating in a direction reverse to the sheet feeding direction, and said separation roller cooperating with said feed roller to separate a sheet from the sheets fed out from said sheet supporting means by said feed roller one by one; and slip means to generate slip between said feed roller and the sheet within a predetermined range when said feed roller starts rotating, thereby preventing the feeding of the sheet and rotating said separation roller in the sheet feeding direction.

2. A sheet feeding apparatus according to claim 1, wherein said separation roller is a friction separation roller which can be rotated in a direction opposite to the sheet feeding direction.

3. A sheet feeding apparatus according to claim 1, wherein said separation means comprises a friction separation which can be urged against said sheet feed means.

4. A sheet feeding apparatus according to claim 1, wherein said feed roller is transmitted drive via torque limiter.

5. A sheet feeding apparatus according to claim 1, wherein said feed roller is provided at a part of its outer surface with a cut flat portion which can be opposed to the sheet supported by said sheet supporting means in a non-sheet feeding condition so that said feed roller is rotated from the position where said cut flat portion is opposed to the sheet to feed out the sheet by a peripheral surface of said roller, and further wherein said slip means is provided at a junction between said cut flat portion and said peripheral surface so that, when the feeding of the sheet is started, after said feed roller is slipped on the sheet via said slip means within a predetermined range, the peripheral surface of said feed roller is urged against the sheet to feed the sheet.

6. A sheet feeding apparatus according to claim 5, wherein said slip means continues the slipping operation until said feed roller is rotated from the condition that said cut flat portion of said feed roller is opposed to said separation roller to a condition that said peripheral surface of said feed roller is opposed to said separation roller.

7. A sheet feeding apparatus according to claim 6, wherein said slip means is disposed at a side of said feed roller not contactable with said separation roller and has a protruded portion protruding radially outwardly more than said peripheral surface of said feed roller.

8. A sheet feeding apparatus according to claim 1, further comprising spacing means for spacing said feed roller away from the sheet being fed on the way of the feeding of the sheet supported by said sheet supporting means effected by said feed roller, when the sheet is supplied.

9. A sheet feeding apparatus according to claim 8, wherein said spacing means includes said feed roller provided at a part of its outer surface with a cut flat portion and, said feed roller is spaced apart from the sheet by opposing said cut flat portion to the sheet on the way of the feeding of the sheet effected by the contact between the sheet and a peripheral surface of said feed roller.

10. A sheet feeding apparatus according to claim 8, wherein said spacing means comprises a rockable intermediate plate provided in said sheet supporting means and adapted to support the sheets, biasing means for biasing said intermediate plate toward said feed roller, and cam means for separating said intermediate plate from said feed roller in opposition to the biasing force of said biasing means.

11. A sheet feeding apparatus according to claim 8, further comprising a release means for separating said separation roller from said feed roller in synchronous with the separation between the sheet and said feed roller.

12. A sheet feeding apparatus according to claim 11, further comprising a double-feed preventing means for entering between said feed roller and said separation roller in synchronous with the separation between said feed roller and said separation roller, thereby preventing double-feed of sheets.

13. A sheet feeding apparatus according to claim 12, wherein said double-feed preventing means is a sheet return lever supported for rocking movement, and said sheet return lever is positioned at a waiting position when the sheets are separated by said separation roller and is rocked to move to an operating position when said separation roller is separated from said feed roller and return the sheet to said sheet supporting means.

14. A sheet feeding apparatus according to claim 13, wherein a pawl is provided on a portion of said sheet return lever against which the sheet abuts, and said pawl returns the sheets by engaging with tip ends of the sheets.

15. A sheet feeding apparatus according to claim 13, wherein said sheet return lever serves to regulate a tip end of the sheet supported by said sheet supporting means when it is positioned at said operating position.

16. A sheet feeding apparatus according to claim 15, wherein said sheet supporting means serves to support the sheet in an inclined condition that a downstream end of the sheet in the sheet feeding direction is positioned lower than the other end, and, said sheet return lever, when positioned at said operating position, regulates the tip end of the sheet trying to shift on said sheet supporting means by its own weight.

17. An image forming apparatus comprising:

sheet supporting means for supporting sheets;

a feed roller disposed at a downstream side of the sheets supported by said sheet supporting means in a sheet feeding direction to feed out a sheet by rotating;

a separation roller disposed at a downstream side of said sheet supporting means in the sheet feeding direction in a confronting relation to said feed roller, said separation roller rotating in a direction reverse to the sheet feeding direction, and said separation roller cooperating with said feed roller to separate a sheet from the sheets fed out from said sheet supporting means by said feed roller one by one;

slip means provided in said sheet feed to generate slip between said feed roller and the sheet within a predetermined range when said feed roller starts rotating, thereby preventing the feeding of the sheet and rotating said separation roller in the sheet feeding direction; and an image forming means for forming an image on the sheet separated and fed by said feed roller and said separation roller.

* * * * *

UNITED STATES PATENT AND TRADEMARK OFFICE

CERTIFICATE OF CORRECTION

PATENT NO. : 6,059,281
DATED : May 9, 2000
INVENTOR(S) : Fumihiko Nakamura et al.

It is certified that error appears in the above-identified patent and that said Letters Patent is hereby corrected as shown below:

Title page,
Item [56], References Cited,
FOREIGN PATENT DOCUMENTS, "358069642" should read -- 58-69642 --; and "403162331" should read -- 3-162331 --.

Column 2,
Line 12, "cutted" should read -- cut --.
Line 46, "cutted" should read -- cut --.
Line 67, "(cutted" should read -- (cut --.

Column 3,
Line 8, "cutted" should read -- cut --.

Column 7,
Line 3, "slid" should read -- slide --.
Line 32, "from the" should read -- from --.

Column 10,
Line 23, "a" should read -- ∝ --.
Line 66, "revedrse" should read -- reverse --.

Column 11,
Line 62, "cutted" should read -- cut --.

Column 12,
Line 65, "Immieditely" should read -- Immediately --.

Column 13,
Line 55, "rolelr" should read -- roller --.
Line 66, "rolelr" should read -- roller --.

Column 14,
Line 44, "cutted"should read -- cut --.

Column 17,
Line 4, "rolelr" should read -- roller --.
Line 18, "cutted" should read -- cut --.
Line 37, "retating" should read -- rotating --.
Line 43, "in perpendicular" should read -- perpendicularly --.

UNITED STATES PATENT AND TRADEMARK OFFICE

CERTIFICATE OF CORRECTION

PATENT NO. : 6,059,281
DATED : May 9, 2000
INVENTOR(S) : Fumihiko Nakamura et al.

It is certified that error appears in the above-identified patent and that said Letters Patent is hereby corrected as shown below:

Column 19,
Line 35, "another" should read -- other --.

Column 20,
Line 5, "is transmitted drive" should read -- drive is transmitted --.
Line 50, "in synchronous" should read -- synchronously --.
Line 55, "in synchronous" should read -- synchronously --.

Signed and Sealed this

Twenty-seventh of November, 2001

*Attest:*

Nicholas P. Godici

*Attesting Officer*

NICHOLAS P. GODICI
*Acting Director of the United States Patent and Trademark Office*